US006250964B1

(12) United States Patent
Fair et al.

(10) Patent No.: US 6,250,964 B1
(45) Date of Patent: Jun. 26, 2001

(54) SHIELD FOR A JACK

(75) Inventors: Mervin Fair, deceased, late of Glen Rock, by Judith S. Fair executor; Jeffrey Fleming, York, both of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/169,628

(22) Filed: Oct. 9, 1998

Related U.S. Application Data

(60) Provisional application No. 60/061,466, filed on Oct. 9, 1997.

(51) Int. Cl.[7] ..... H01R 13/648; H01R 13/60; H01R 13/66; H01R 24/00

(52) U.S. Cl. ..... 439/607; 439/567; 439/439; 439/676

(58) Field of Search ..... 439/607, 637, 439/676, 567, 353

(56) References Cited

U.S. PATENT DOCUMENTS

| | | | | |
|---|---|---|---|---|
| 4,220,391 | | 9/1980 | Krolak et al. . | |
| 4,478,252 | * | 10/1984 | McLoughlin | 138/140 |
| 4,571,012 | * | 2/1986 | Bassler et al. | 339/14 R |
| 4,734,043 | | 3/1988 | Emert et al. | 439/65 |
| 4,767,338 | | 8/1988 | Dennis et al. | 439/55 |
| 4,993,970 | | 2/1991 | Littrell | 439/535 |
| 5,078,609 | | 1/1992 | Bouchan et al. | 439/43 |
| 5,145,380 | | 9/1992 | Holcomb et al. | 439/49 |
| 5,167,530 | | 12/1992 | Wallgren et al. | 439/540 |
| 5,277,625 | * | 1/1994 | Iannella et al. | 439/620 |
| 5,362,257 | | 11/1994 | Neal et al. | 439/676 |
| 5,378,172 | * | 1/1995 | Roberts | 439/607 |
| 5,531,612 | | 7/1996 | Goodall et al. | 439/541.5 |
| 5,562,507 | | 10/1996 | Kan | 439/676 |
| 5,622,519 | * | 4/1997 | Bixler et al. | 439/570 |
| 5,626,488 | * | 5/1997 | Albeck et al. | 439/395 |
| 5,637,015 | * | 6/1997 | Tan et al. | 439/607 |
| 5,639,267 | * | 6/1997 | Loudermilk | 439/701 |
| 5,697,815 | * | 12/1997 | Drewnicki et al. | 439/638 |
| 5,703,753 | * | 12/1997 | Mok | 361/715 |
| 5,773,763 | | 6/1998 | Stachulla | 174/135 |
| 5,788,538 | * | 8/1998 | Belopolsky et al. | 439/607 |
| 5,876,247 | * | 3/1999 | Hashimoto | 439/607 |
| 5,934,940 | * | 8/1999 | Maranto et al. | 439/607 |
| 6,024,590 | * | 2/2000 | Mackwiak et al. | 439/247 |

* cited by examiner

*Primary Examiner*—Lincoln Donovan
*Assistant Examiner*—Chandrika Prasad
(74) *Attorney, Agent, or Firm*—Steinberg & Raskin, P.C.

(57) ABSTRACT

A metallic shield for a jack, and a method for joining a shield to a jack using staking posts, comprising a plurality of planar panels, each for overlying an outer surface of a respective outer wall of the jack, a front one of the panels including at least one aperture for allowing passage of a plug therethrough. At least one of the panels has at least one cantilevered spring beam and at least one bifurcated grounding tab connected to each of the at least one spring beam. A post for mounting the jack is formed from the metallic shield material.

27 Claims, 26 Drawing Sheets

SHIELD FOR A JACK

CROSS-REFERENCE TO RELATED APPLICATION

This application is related to U.S. provisional patent application Ser. No. 60/061,466 filed Oct. 9, 1997.

FIELD OF THE INVENTION

The present invention relates to the field of modular connectors and more particularly, to the field of metallic shields for modular jacks.

BACKGROUND OF THE INVENTION

Data communication networks are being developed which enable the flow of information to ever greater numbers of users at ever higher transmission rates. However, data transmitted at high rates in multi-pair data communication cables have an increased susceptibility to crosstalk, which often adversely affects the processing of the transmitted data. The problem of crosstalk in information networks increases as the frequency of the transmitted signals increases.

In the case of local area network (LAN) systems employing electrically distinct twisted wire pairs, crosstalk occurs when signal energy inadvertently "crosses" from one signal pair to another. The point at which the signal crosses or couples from one set of wires to another may be 1) within the connector or internal circuitry of the transmitting station, referred to as "near-end"crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. The EIA/TIA of ANSI has promulgated electrical specifications for nearend crosstalk isolation in network connectors to ensure that the connectors themselves do not compromise the overall performance of the unshielded twisted pair interconnect hardware typically used in LAN systems. The EIA/TIA Category 5 electrical specifications specify the minimum near-end crosstalk isolation for connectors used in 100 ohm unshielded twisted pair Ethernet type interconnects at speeds of up to 100 MHz.

While it is desirable to use modular connectors for data transmission for reasons of economy, convenience and standardization, such connectors generally comprise a plurality of electrical contacts and conductors that extend parallel and closely spaced to each other thereby creating the possibility of excessive near-end crosstalk at high frequencies.

In addition, as the size of electronic components has become reduced with advances in semiconductor technology, it has become increasingly necessary to increase the number of modular connector ports which can be mounted within a given area.

OBJECTS OF THE INVENTION

It is an object of the invention to provide new and improved shields for modular jacks which are easily securable to a faceplate.

It is another object of the invention to provide new and improved shields for multi-level modular jacks.

It is yet another object of the invention to provide new and improved shields for jacks which enable the jacks to be securely attached to printed circuit boards via the shields.

It is another object of the invention to provide new and improved shields for jacks which are securely attached to the jacks.

SUMMARY OF THE INVENTION

In order to achieve at least some of these objects, and others, in accordance with a first embodiment of the present invention, a metallic shield for a jack comprises a plurality of planar panels, each for overlying an outer surface of a respective outer wall of the jack, a front one of the panels including at least one aperture for allowing passage of a plug therethrough. At least one of the panels has at least one cantilevered spring beam and at least one bifurcated grounding tab connected to each of the at least one spring beam. The spring beam is substantially planar and rotatable relative to a plane of the at least one panel. Each grounding tab may include a pair of fingers extending out of the plane of the spring beam and outward from the jack. The shield may also include at least one attachment tab adapted to be secured within a respective notch in one of the outer walls of the jack, at least one staking aperture adapted to engage with a respective staking post on one of the outer walls of the jack and/or a PCB grounding post. The PCB grounding post includes a leg portion and a foot portion including at least one mount side terminating in a tine. The foot portion is adapted to be inserted into a mounting hole in a printed circuit board to which the jack is mounted such that upon insertion of the foot portion, the at least one mount side is compressed inwardly and presses against sides of the mounting hole.

In another embodiment of the shield, the shield comprises a plurality of planar panels, each overlying an outer surface of a respective outer wall of the jack, a front one of the panels including at least one aperture for allowing passage of a plug therethrough, and at least one grounding post arranged on a respective one of the panels for mounting the jack to a printed circuit board. Each grounding post includes a leg portion and a foot portion having a generally concave shape to thereby project outward from a plane in which the respective one of the panels is situated. The foot portion includes at least one mount side defining a retention edge and a tine. The tine is adapted to guide insertion of the foot portion into a mounting hole on the printed circuit board such that the retention edge abuts against edges of the mounting hole. The grounding post may be arranged on one of the panels overlying a lateral wall of the jack.

In a method for retaining a shield about a jack in accordance with the invention, forming an outwardly extending staking post is formed on an outer wall of the jack, a shield with an aperture arranged to receive the staking post is provided, the shield is placed over the jack such that the staking post extends through the aperture, and pressure is applied to the staking post to cause the staking post to deform and retain the shield.

BRIEF DESCRIPTION OF THE DRAWINGS

A more complete appreciation of the present invention and many of the attendant advantages thereof will be readily understood by reference to the following detailed description when considered in connection with the accompanying drawings in which:

FIG. 3(*b*) is a cross-section through a bi-level offset multi-port jack in accordance with an embodiment of the invention which includes the outer housing of FIGS. 1A–1G, as well as upper and lower inner housing parts in accordance with a second embodiment of the invention;

FIG. 3(*c*) shows a top view of a prior art modular plug;

FIG. 3(*d*) shows a side view of a prior art modular plug;

FIG. 5(*b*) shows an isometric view of a contact arrangement for an upper receptacle in accordance with a first embodiment of the invention;

FIG. 6(*b*) shows a cross-section through the component housing of FIG. 6(*a*);

FIG. 7(*b*) shows a more detailed side view of a grounding post of the shield of FIG. 7(*a*) mounted in a PCB;

FIG. 7(*c*) shows a side view of the shield of FIG. 7(*a*) prior to insertion of the bi-level offset multi-port jack;

DETAILED DESCRIPTION OF THE PREFERRED EMBODIMENTS

Figure 1A:
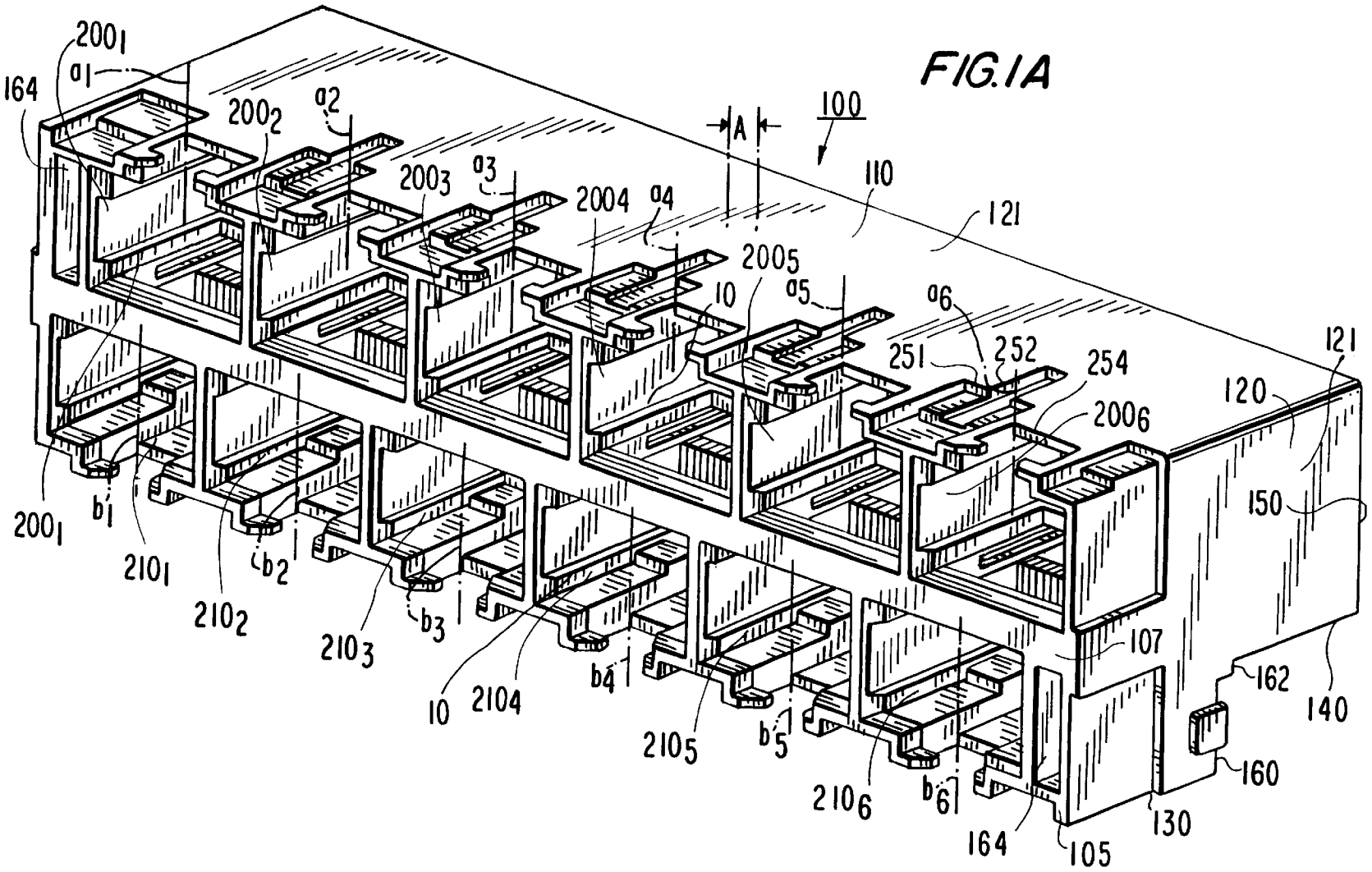
FIG. 1A is a front isometric view of an outer housing part of a bi-level offset multi-port jack in accordance with an embodiment of the invention.

Referring now to the drawings wherein like reference characters designate identical or corresponding parts throughout the several views, a bi-level offset multi-port jack in accordance with the invention is designated generally at 10 and includes an outer housing part 100 (FIGS. 1A–1G), inner housing parts 1000,1100 (FIGS. 2 and 3A) arranged in the outer housing part 100 and an optional shield (FIGS. 7*a*–15).

Figure 1B:
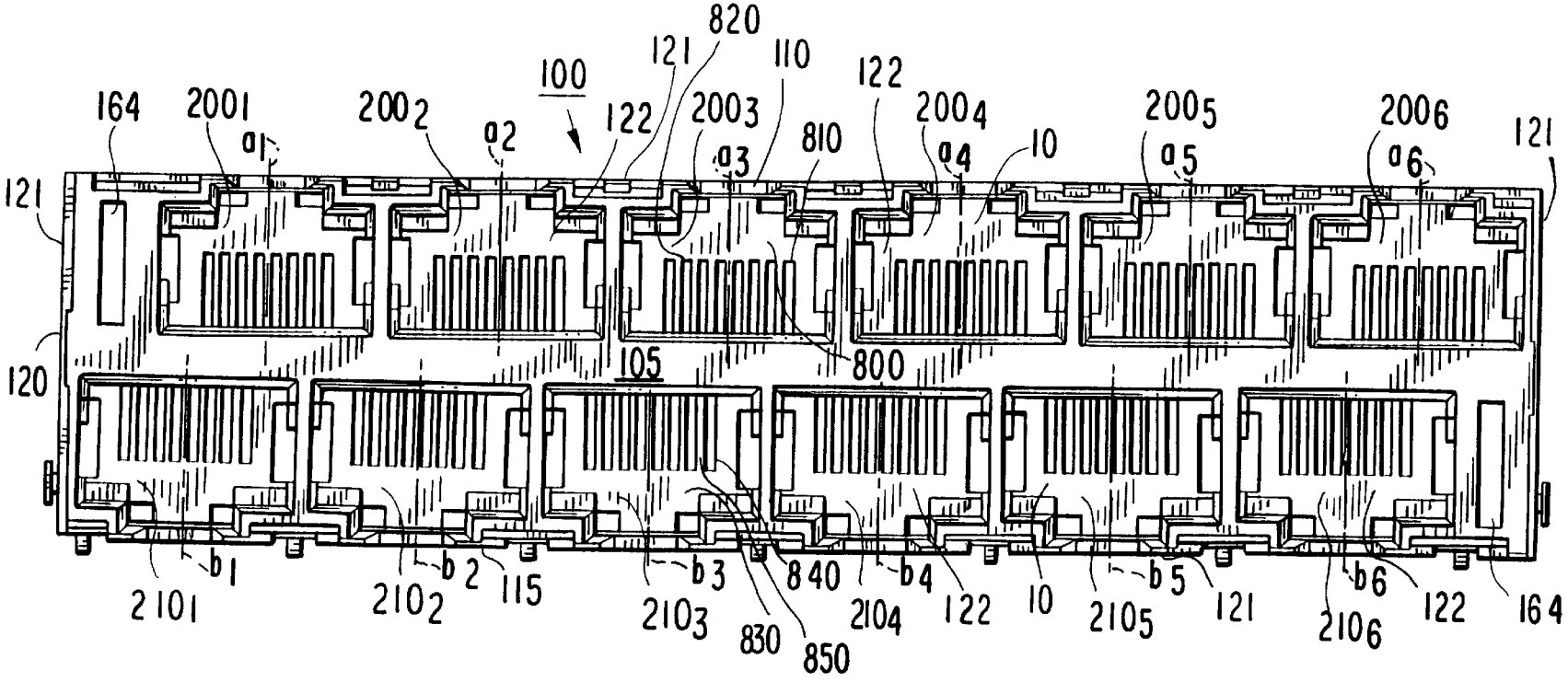
FIG. 1B is a front view of the outer housing part shown in FIG. 1A.

The outer housing part 100 is shown in FIGS. 1A–1G and has a front face 105, a top outer wall 110, a bottom outer wall 115 substantially parallel to the top wall 110, opposed lateral outer walls 120, a forward bottom portion 130, a rearward bottom portion 140, an upper back portion 150 and a lower back portion 160. Outer walls 110, 115 and 120 have outer surfaces 121. The front face 105 of the outer housing part 100 has a mid-portion 107 which is substantially parallel to the top and bottom walls 110,115. The front face 105 defines a first, upper row of six plug apertures $\mathbf{200}_i$, each having a vertical plane of symmetry "$a_i$", and a second, lower row of six plug apertures $\mathbf{210}_i$, each having a vertical plane of symmetry "$b_i$", where i=1 through 6. As shown in FIGS. 1A and 1B, the upper plug apertures $\mathbf{200}_1$ through $\mathbf{200}_6$ are offset from the lower plug apertures $\mathbf{210}_1$ through $\mathbf{210}_6$ such that each center axis $a_i$ is offset from its corresponding center axis $b_i$ by a distance A. In other words, a plug aperture 200 in the upper row is not completely, directly opposite any plug aperture 210 in the lower row. Although six plug aperture are formed in each of the upper and lower rows, it is possible to form the jack with any number of plug apertures in each row (not necessarily the same amount in each row), including with a minimum of a single plug aperture in each row.

Rearward bottom portion 140 and lower back portion 160 form a recess which receives a printed circuit board 300 (shown in phantom lines in FIG. 1A), such that the width of the PCB 300 is less than or equal to the length of lower back portion 160. In the embodiment shown in FIG. 1A, a step 162 is also provided to maintain a gap between the rearward bottom portion 140 and the PCB 300 and prevent contact between the rearward bottom portion 140 and the PCB 300.

A pair of vents 164 are provided in the outer housing part 100 to allow air to flow between the face of the jack 10 and the PCB 300, and the components mounted thereon. Each vent 164 extends from an opening in the front face 105 to a rear of the outer housing part 100. The vents 164 do not necessarily have to take the form shown in the illustrated embodiments and moreover, may be utilized in connection with a jack other than the illustrated jack.

Figure 2:
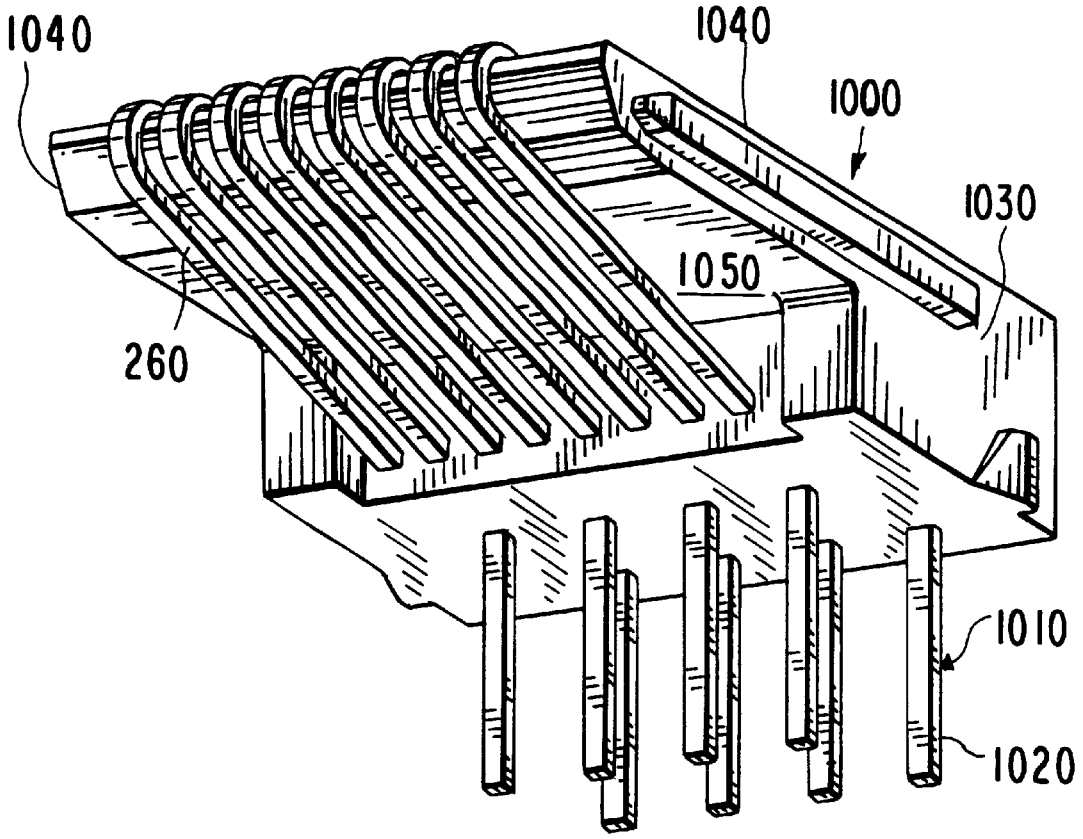
FIG. 2 is an isometric view of a lower inner housing part of a bi-level offset multi-port jack in accordance with an embodiment of the invention.

Referring to FIG. 2, a lower inner housing part (also referred to herein as a lower insert) 1000 includes a generally L-shaped dielectric body 1030 and eight contact/terminal members 1010 which include respective contact portions 260 and respective terminal portions 1020. Preferably, the contact/terminal members 1010 are mounted within the dielectric body 1030 by injection molding, although other mounting methods known in the art may be utilized. The dielectric body 1030 includes a pair of elongate ribs 1040 on opposing sides of the body 1030. Upon insertion of the lower inserts 1000 into the outer housing part 100, a plug receiving receptacle receivable of a mating plug is formed in alignment with a respective one of the plug apertures 210 in the lower row. Each plug receiving receptacle is defined by opposed interior walls of the outer housing part 100 (or by one interior wall and the inner surface of a lateral wall 120 of the outer housing part 100), a comb portion 122 of the outer housing part 100, an inner surface of the bottom wall 115 of the outer housing part 100, an upper lip 124 projecting inward from the mid-portion 107 of the front face 105 of the outer housing part 100 and the lower surface 1050 of the respective lower insert 1000.

Figure 3A:
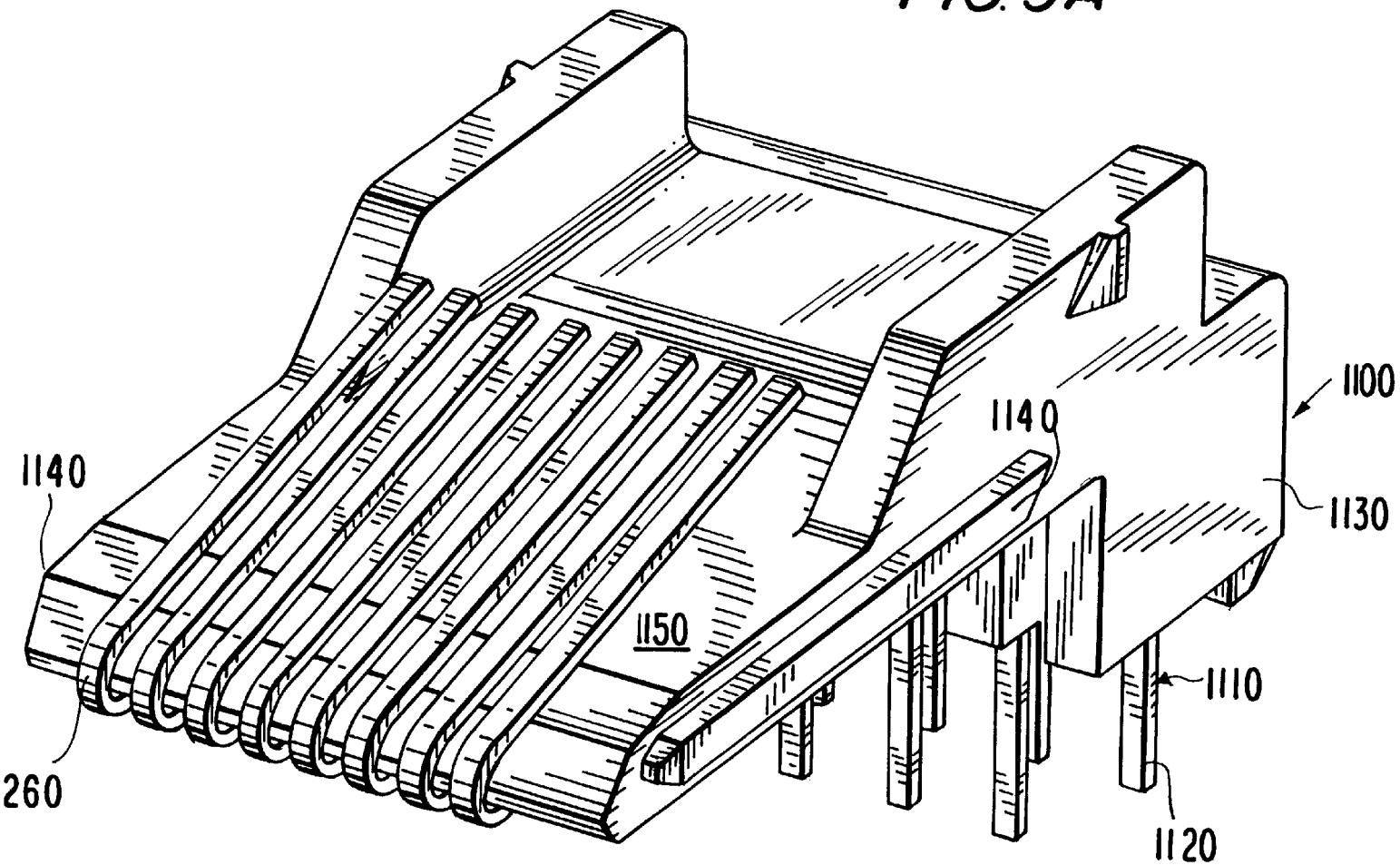
FIG. 3(*a*) shows an isometric view of an upper inner housing part of a bi-level offset multi-port jack in accordance with an embodiment of the invention.

Referring to FIG. 3*a*, an upper inner housing part (also referred to herein as an upper insert) 1100 includes a generally L-shaped dielectric body 1130 and eight contact/terminal members 1110 which include respective contact portions 260 and respective terminal portions 1120. Preferably, the contact/terminal members 1110 are mounted within the dielectric body 1130 by injection molding, although other mounting methods known in the art may be utilized. The dielectric body 1130 includes a pair of elongate ribs 1140 on opposing sides of the body 1130. Upon insertion of the upper inserts 1100 into the outer housing part 100, a plug receiving receptacle receivable of a mating plug is formed in alignment with a respective one of the plug apertures 200 in the upper row of the front face 105 of the outer housing part 100. Each plug receiving receptacle is defined by opposed interior walls of the outer housing part 100 (or by one interior wall and the inner surface of a lateral wall 120 of the outer housing part 100), a comb portion 122 of the outer housing part 100, an inner surface of the top wall 110 of the outer housing part 100, a lower lip 126 projecting inward from the mid-portion 107 of the front face 105 of the outer housing part 100 and the upper surface 1150 of the respective upper insert 1100.

Other constructions of upper and lower inserts may be used in accordance with the invention, e.g., a mixture of forward facing contact/terminal members and rearward facing contact/terminal members.

Figure 1C:
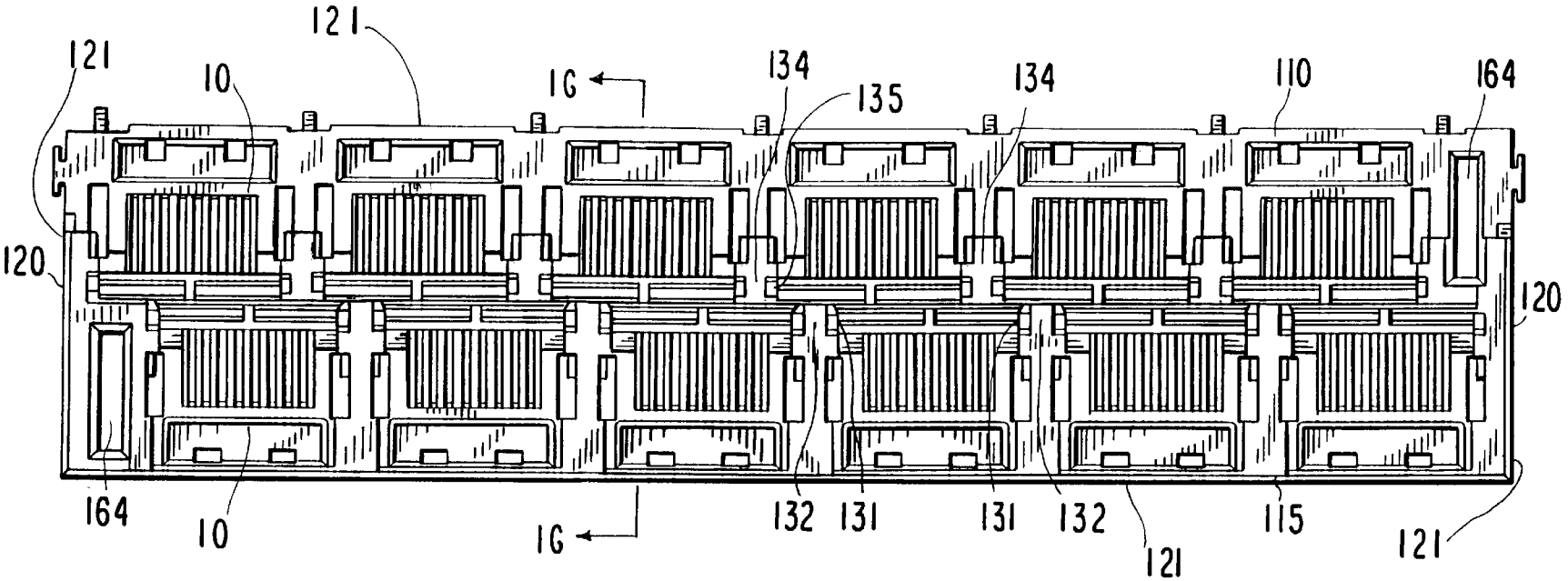
FIG. 1C is a rear view of the outer housing part shown in FIG. 1A.
Figure 4:
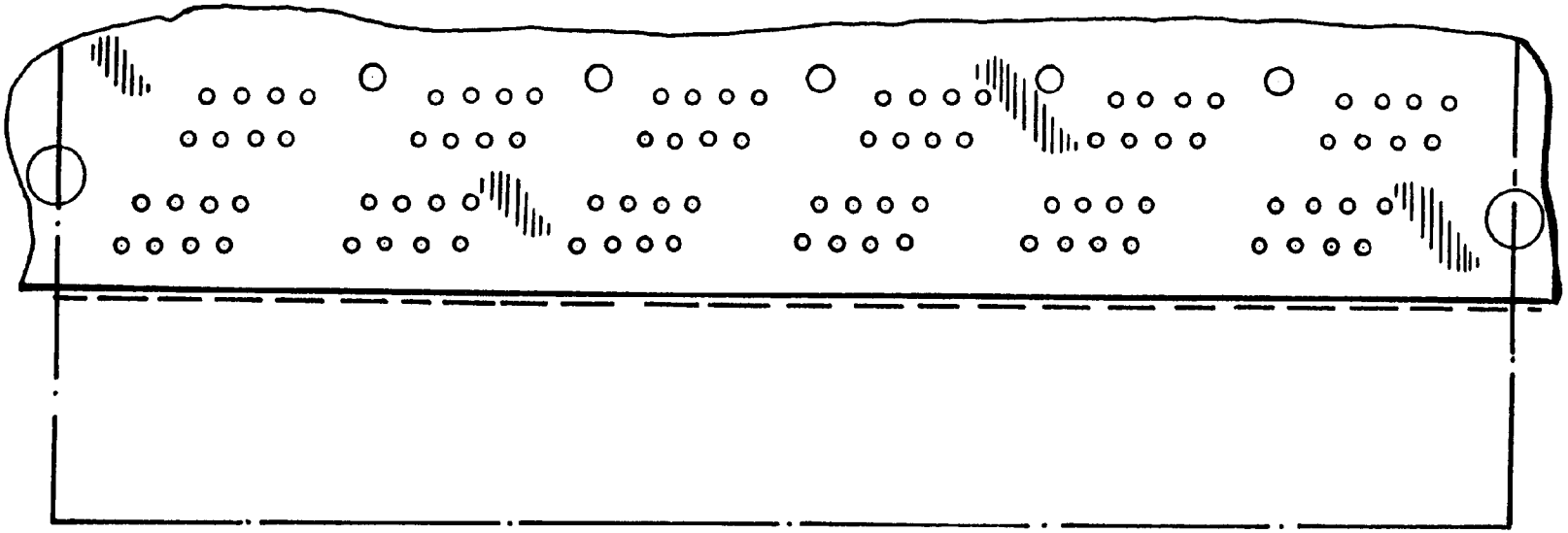
FIG. 4 shows a top view of a PCB for the bi-level offset multi-port jack of FIGS. 1–3(*a*)

To assemble the jack 10, each lower insert 1000 is inserted into the outer housing part 100 by sliding the ribs 1040 thereof into a pair of opposed channels 131 formed between members 132 (FIG. 1C), and each upper insert 1100 is inserted into the outer housing 100 by sliding the ribs 1140 into channels 135 formed between members 134 (FIG. 1C). Once the jack 10 is assembled by inserting the lower and upper inserts 1000 and 1100 into the outer housing part 100, the jack 10 may be mounted to the PCB 300. FIG. 4 shows an illustrative PCB 300 which includes plated through holes which correspond to the positions of the terminal portions 1020, 1120 of the contact/terminal members 1010,1110 of the lower and upper inserts 1000,1100, respectively.

Figure 1D:
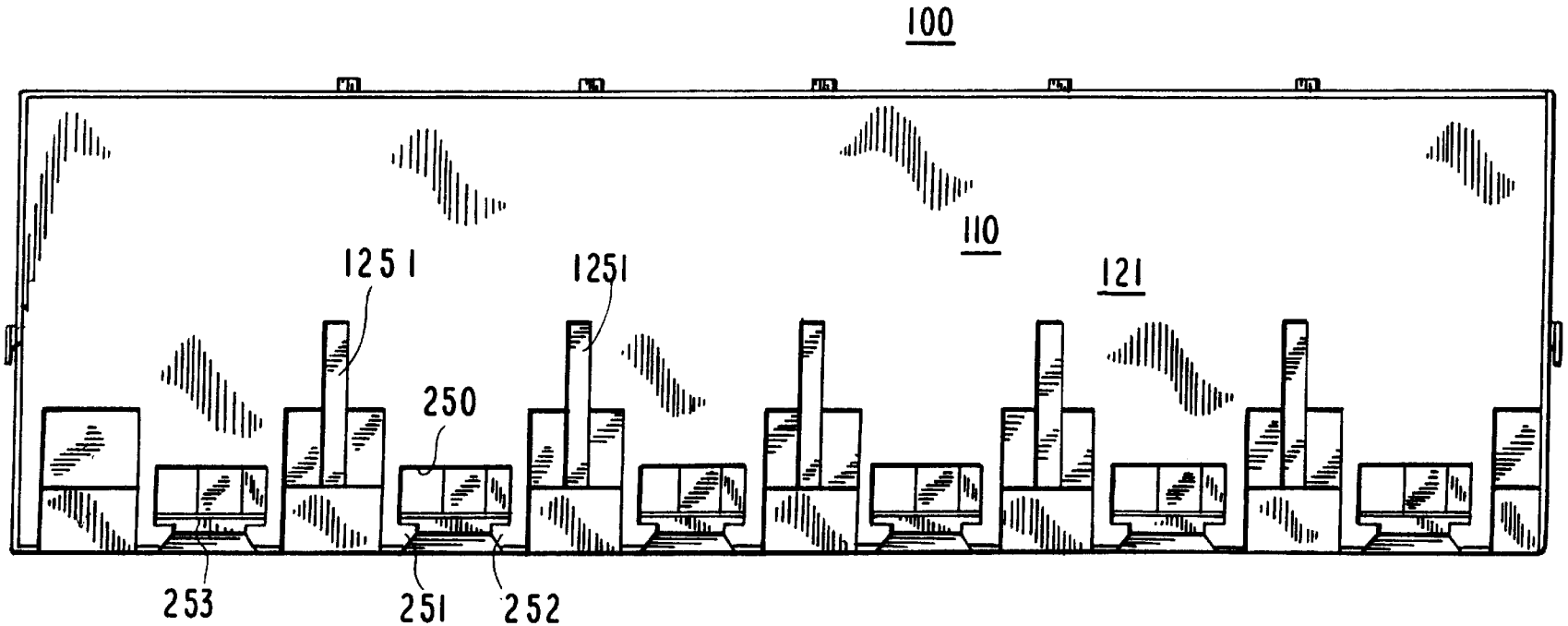
FIG. 1D is a top view of the outer housing part shown in FIG. 1A.
Figure 1E:
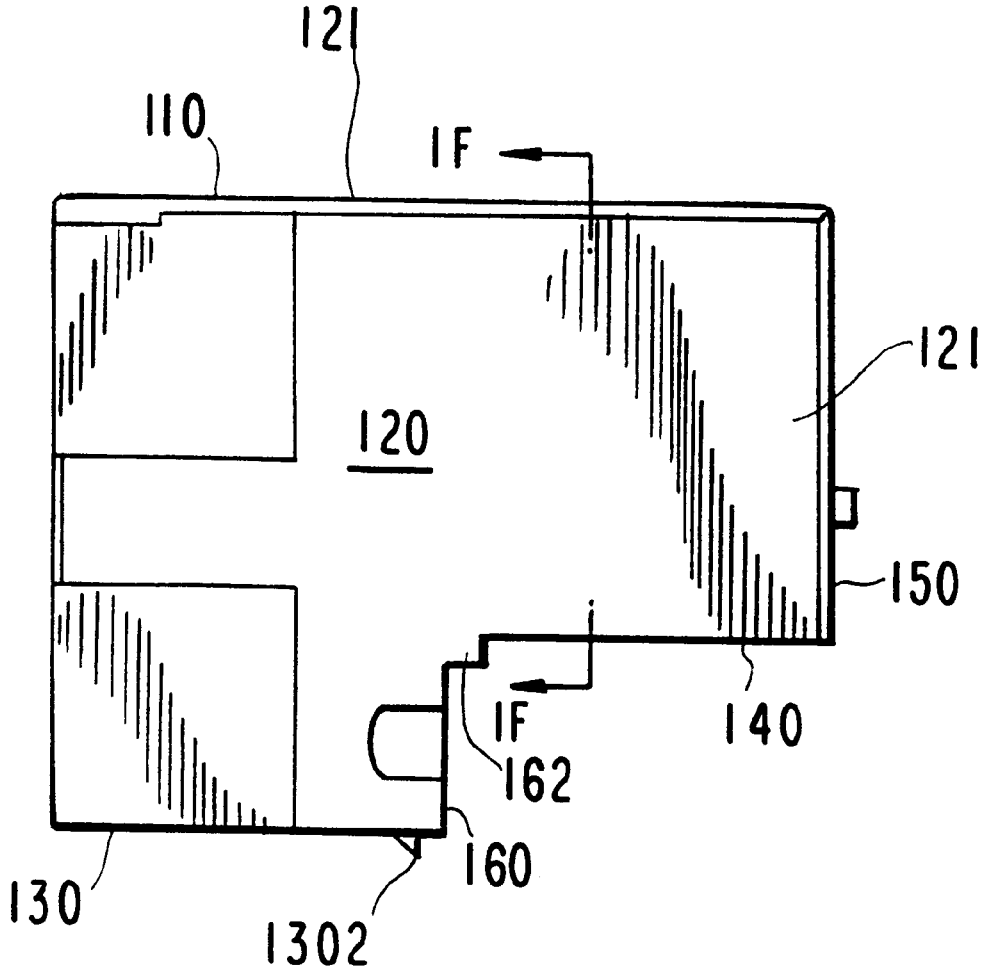
FIG. 1E is a right side view of the outer housing part shown in FIG. 1A.
Figure 1F:
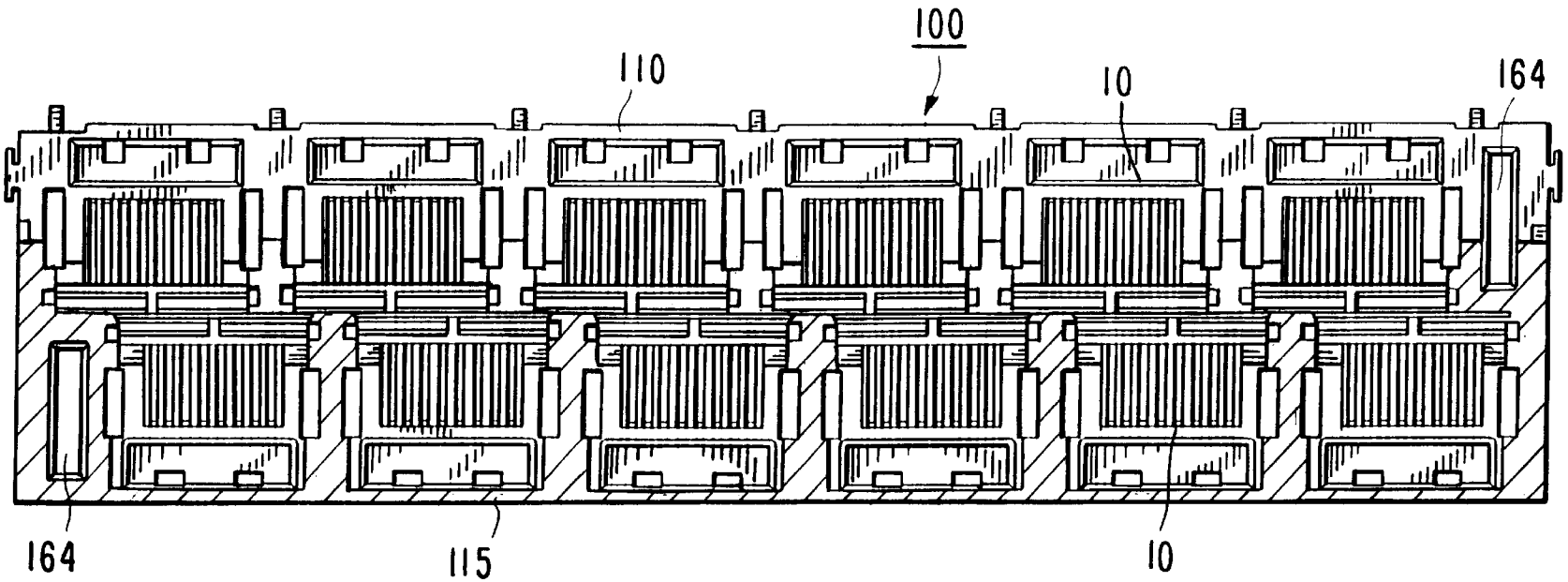
FIG. 1F is view taken along the line 1F—1F of FIG. 1E.

Referring to FIGS. 1A–1G, 2, 3(*a*)–3(*d*), each plug receiving receptacle in the upper and lower row of the jack 10 is configured to receive a respective modular connector plug 220. In this regard, the top wall 110 and bottom wall 115 of the outer housing part 100 includes a latching cutout 250. Each plug 220 includes a plurality of parallel conductor blades 230, and a resilient plug latch 240. When a plug 220 is inserted into one of the receptacles, the conductor blades 230 engage the contact portions 260 of the contact/terminal members 1010,1110, and the resilient plug latch 240 engages the latching cutout 250. In order to reduce the size of the jack 10, each latching cutout 250 comprises an aperture 253 which is partially enclosed by a pair of protrusions 251, 252 (FIG. 1D).

With this construction, when a plurality of bi-level multi-port jacks 10 are mounted vertically above one another on respective PCBs, and plugs 220 are inserted into each receptacle of each jack 10, the plug latch 240 of a plug 220 inserted into an upper receptacle of one jack 10 will not interfere with the plug latch of a plug inserted into a lower receptacle of another jack 10. In addition, since the PCB 300 is mounted within the recess formed by rearward bottom portion 140 and lower back portion 160 (behind the lower row of plug receiving receptacles), the space required for the jack and PCB assembly is reduced as compared to prior art configurations in which the jack is mounted entirely on top of the PCB. In this regard, it is important to note that the provision of a recess in a multi-level jack is independent on the arrangement of plug-receiving receptacles and aligning plug apertures in the front face of the outer housing part of such a jack. In other words, a multi-level jack having a recess at a lower rear for receiving a PCB without offset plug apertures in the front face of the outer housing part is within the scope of the invention.

Figure 6A:
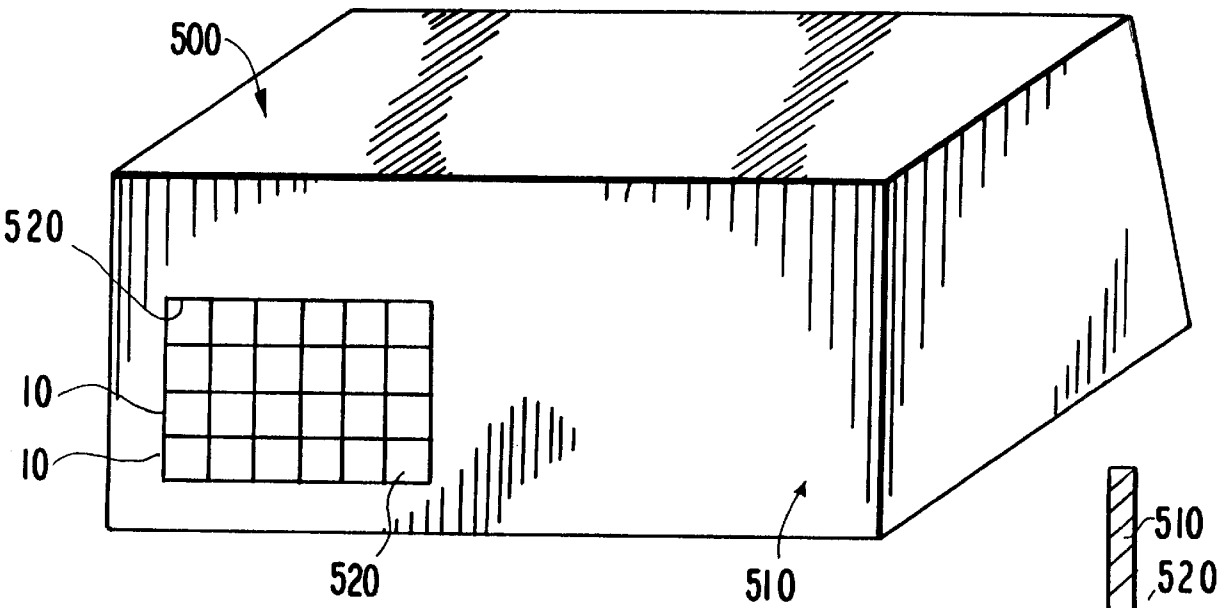
FIG. 6(*a*) shows a pair of bi-level offset multi-port jacks mounted within a component housing.
Figure 6B:
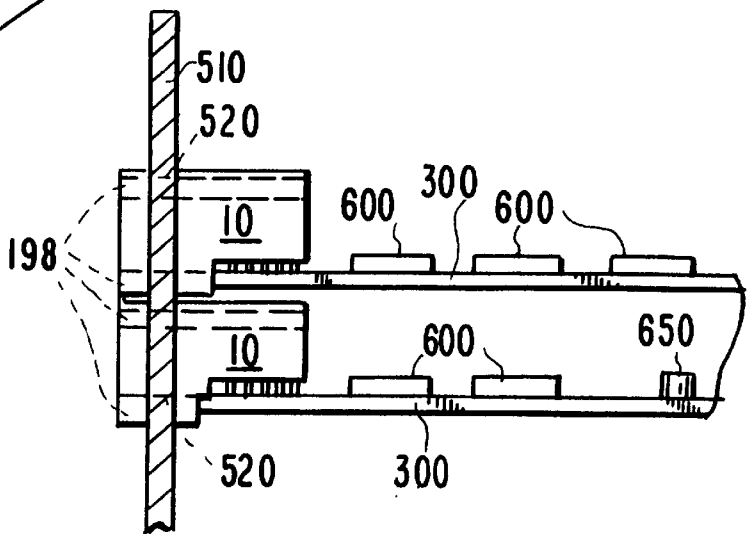

In certain applications, it is contemplated that the front portion of the jack 10 will be disposed within a cut-out of a face plate of a larger housing. Referring to FIGS. 6*a* and 6*b*, an electrical component housing 500 is shown schematically with a pair of bi-level offset multiple port jacks 10 mounted thereon. The component housing 500 includes a face plate 510 with a pair of cutouts 520 formed therein. A pair of jacks 10 extend partially through the face plate 510 and are mounted to respective PCBs 300 having various electrical components 600 mounted thereon. The offset arrangement of the plug apertures 200,210 of each jack 10 allow the cutouts 520 (and thus the jacks 10) to be arranged more closely to one another, thereby saving space. In addition, it would be possible to replace the pair of cutouts 520 with a single cutout, and to stack the jacks 10 directly on top of one another. In addition, referring to FIG. 6*b*, the vents 164 of the jacks 10, which are indicated by dashed lines, provide ventilation to the PCBs 300 by allowing air to flow into and out of the interior of the component housing 500. In this manner, the electrical components 600 on the PCBs 300 may be cooled by the flow of air through the vents 164.

The provision of vents for allowing air flow through a jack, and in particular, a multi-port jack, is independent of the provision of offset plug apertures n the front face of the outer housing part and may be utilized in a multi-port jack without offset plug apertures.

Figure 3B:
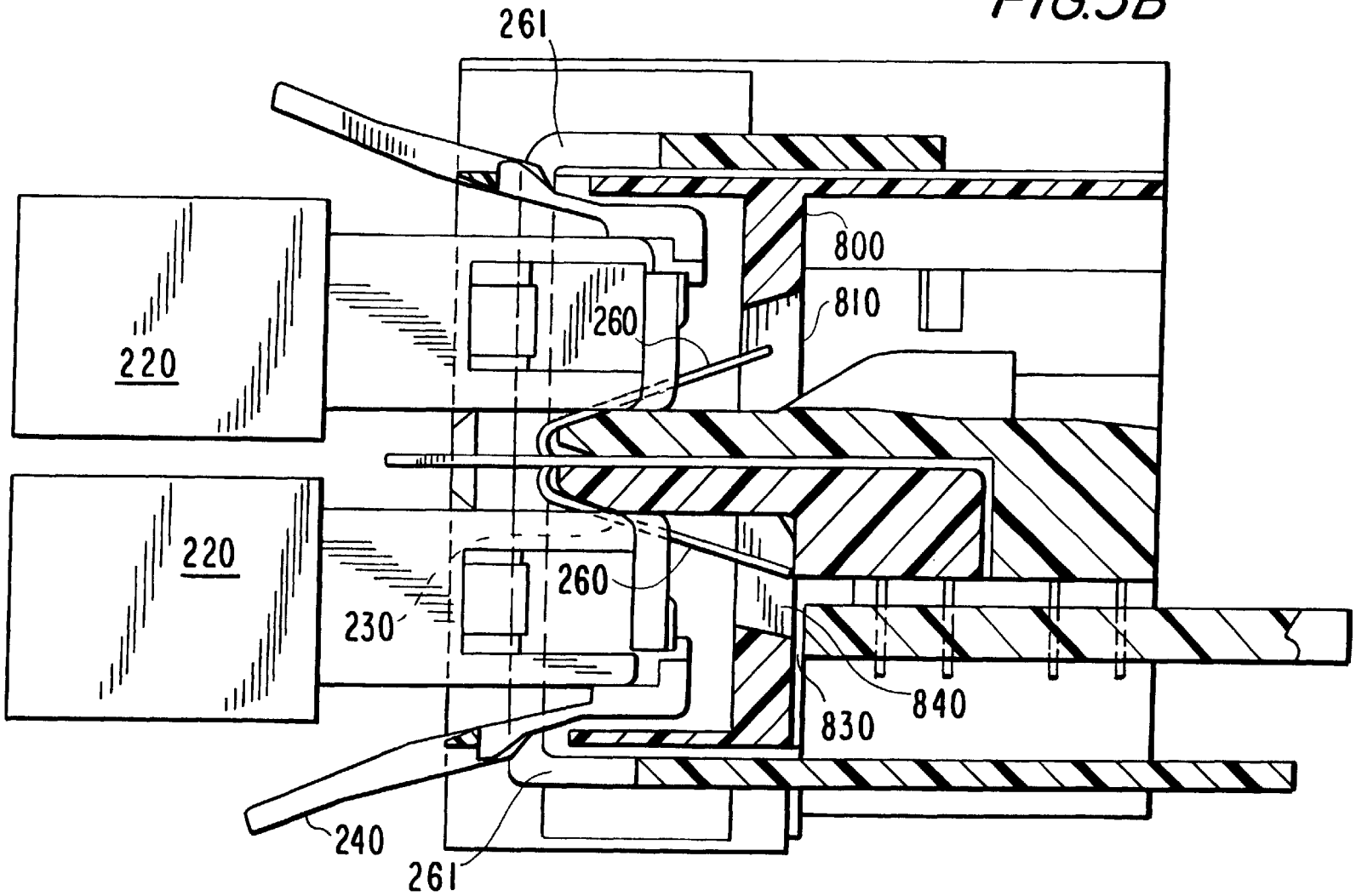

FIG. 3*b* shows another manner in which a jack 10 may be mounted within a face plate of a larger housing. In this application, a generally U-shaped housing 261 has a cutout formed in its closed end, and the jack 10 and at least a portion of the PCB 300 are disposed within the U-shaped housing 261. In this type of application, a plurality of U-shaped housings 261 are generally stacked on top of one another. Therefore, the offset arrangement of the plug apertures 200, 210 of the jack 10 allow the U-shaped housings to be stacked more closely to one another, thereby saving space. Ventilation of the PCB 300 is accomplished via the vents 164 in the manner described above with regard to FIG. 6*b*.

Figure 1G:
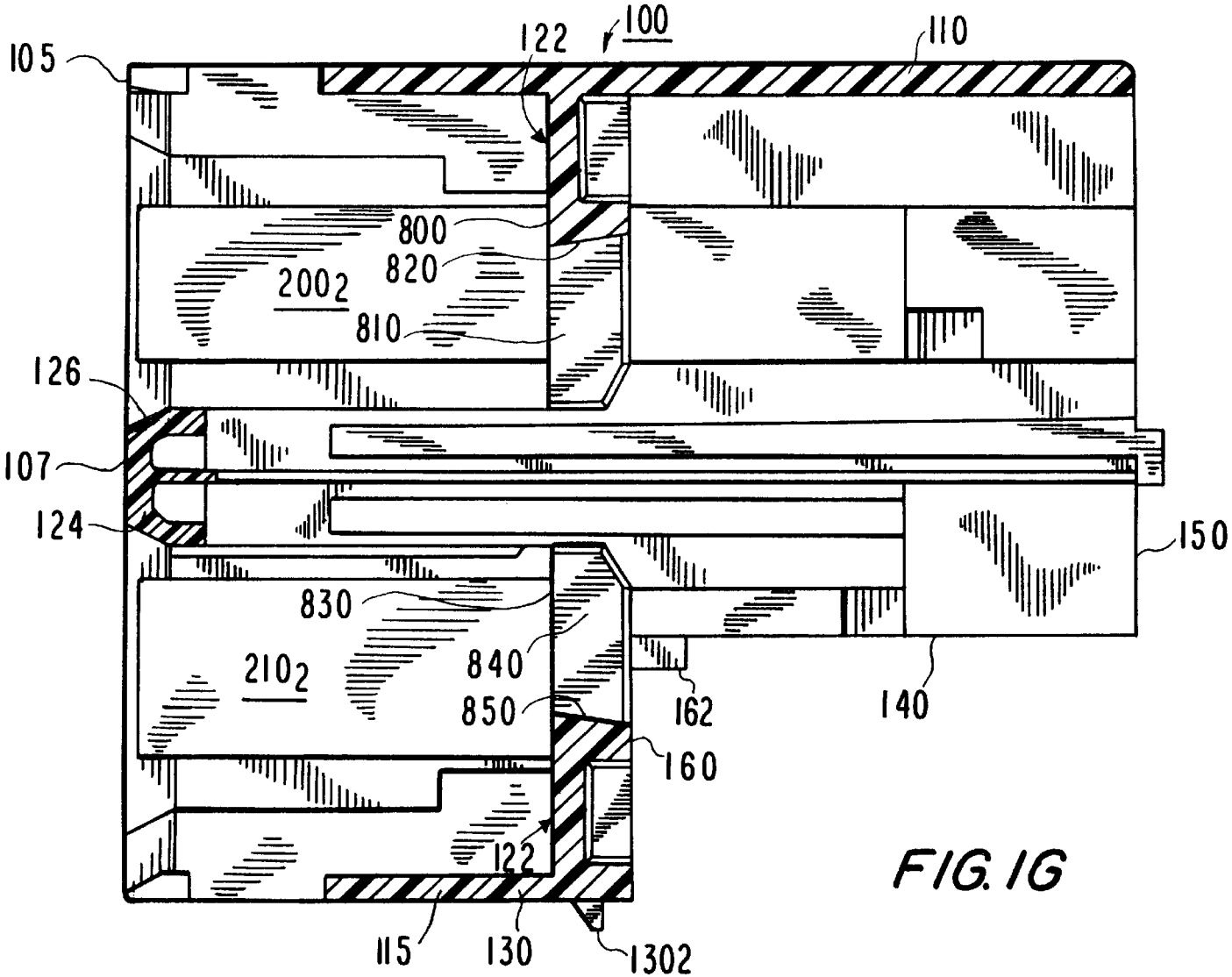
FIG. 1G is a view taken along the line 1G—1G of FIG. 1C.

Referring again to FIGS. 1A–1G, 2 and 3*a* through 3*b*, the manner in which the contact/terminal members 1010,1110 are mounted within the outer housing part 100 will now be described in detail. Each upper plug receiving receptacle is defined by a comb portion 122 having interior wall 800 having a plurality of longitudinally spaced partitions 810 extending downwardly therefrom which define slots 820 for receiving a contact portion of its respective contact/terminal members 1110 (FIGS. 1B and 1G). Each lower plug receiving receptacle is defined by a comb portion 122 having interior wall 830 having a plurality of longitudinally spaced partitions 840 extending upwardly therefrom which define slots 850 for receiving a contact portion of its respective contact/terminal members 1010 (FIGS. 1B and 1G).

Figure 5A:
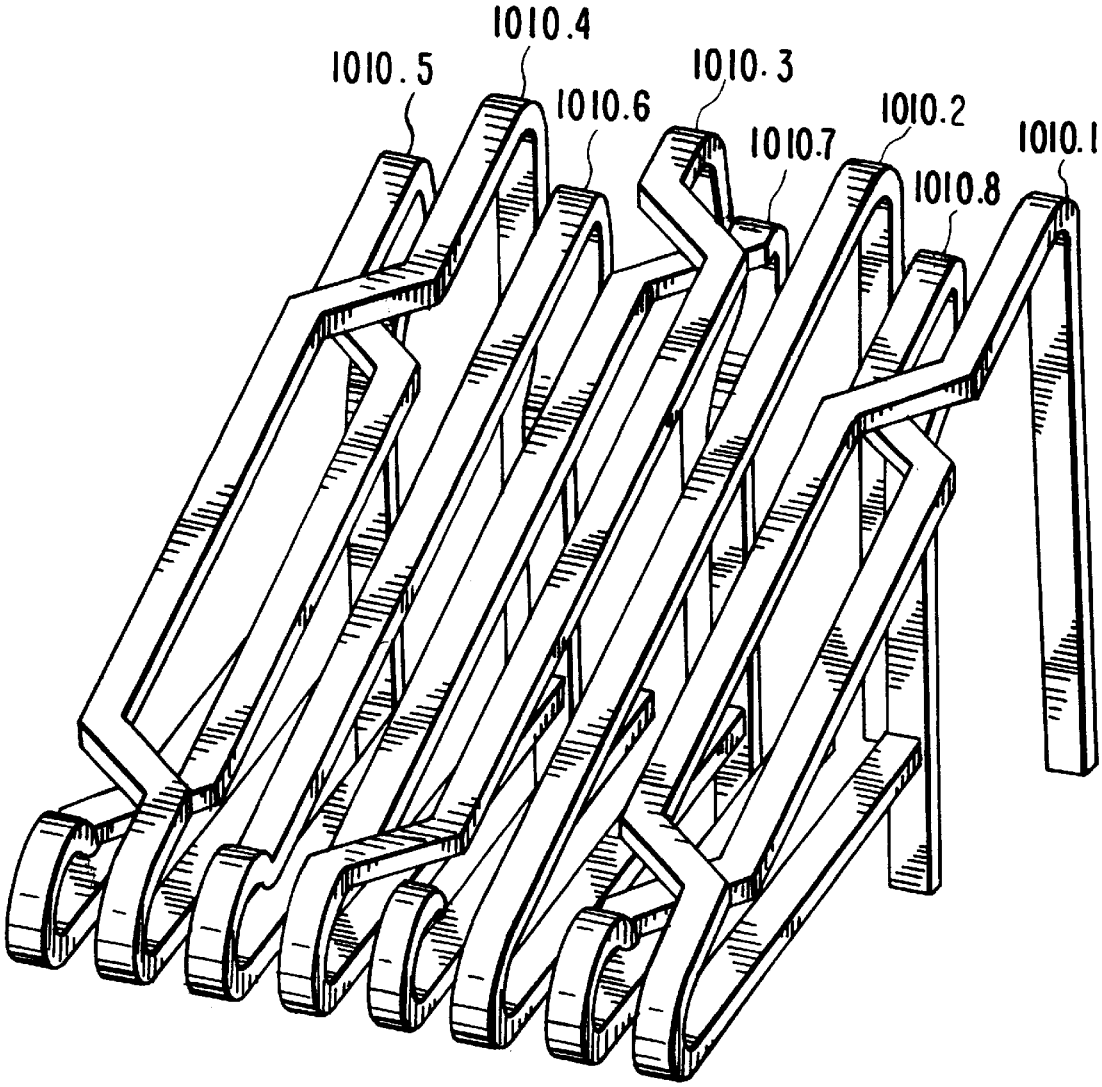
FIG. 5(*a*) shows an isometric view of a contact arrangement for a lower receptacle in accordance with a first embodiment of the invention.
Figure 5B:
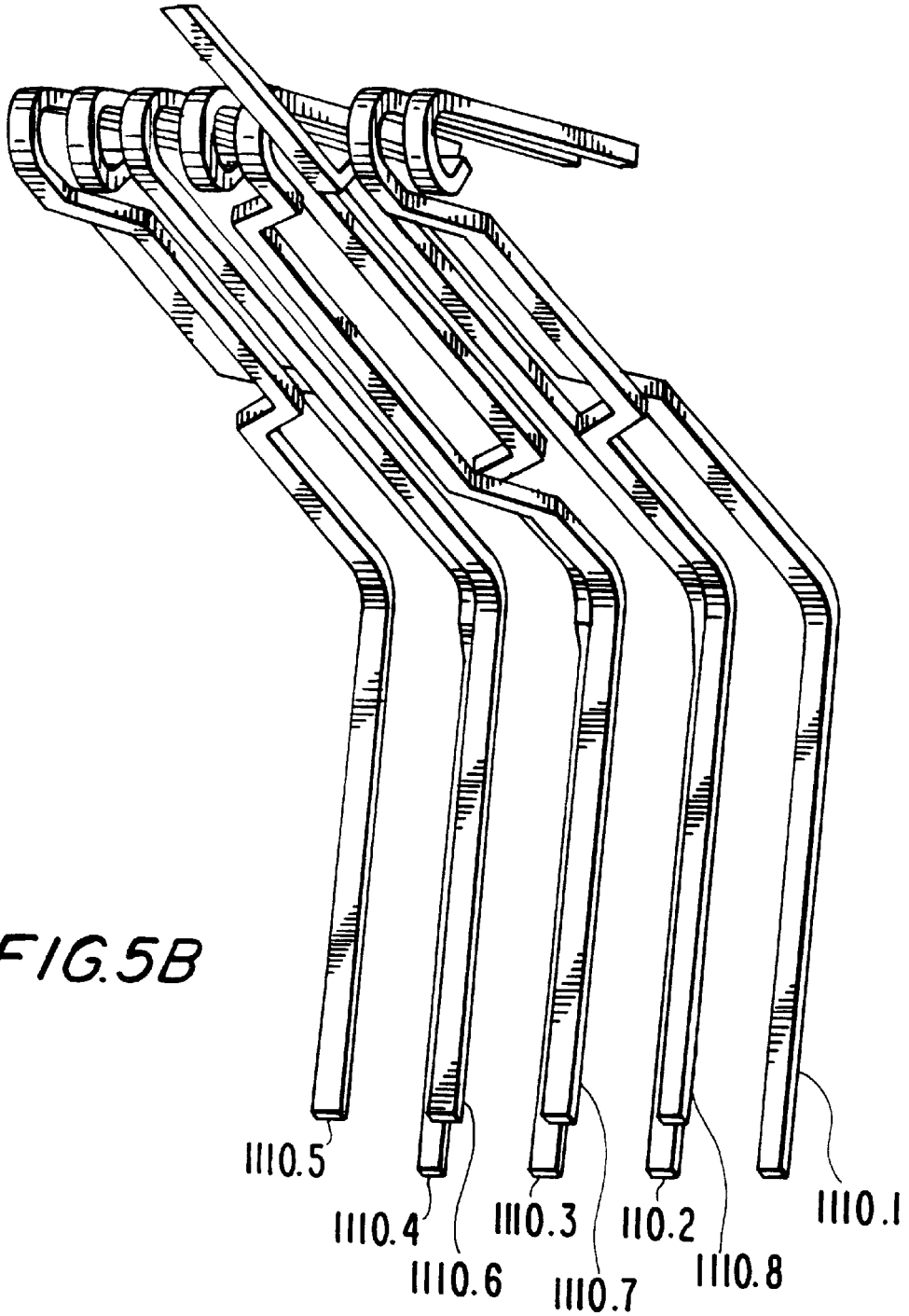

FIG. 5*a* shows an isometric view of the contact/terminal members 1010 of the lower insert 1000 and FIG. 5*b* shows an isometric view of the contact/terminal members 1110 of the upper insert 1100 in accordance with one embodiment of the invention. In accordance with the embodiments shown in FIGS. 5*a* and 5*b*, a double crossover is provided between: contact/terminal members 1010.1 and 1010.8, contact/terminal members 1110.1 and 1110.8, contact/terminal members 1010.3 and 1010.7, contact/terminal members 1110.3 and 1110.7, contact/terminal members 1010.4 and 1010.5, and contact/terminal members 1110.4 and 1110.5. This provides a double crossover of three wire pairs: 1&2, 4&5, and 7&8. It should be noted, however, that a double crossover of 1, 2 or 4 wire pairs may alternatively be provided. Moreover, it should be noted that the double-crossover aspect of the present invention may also be employed in single port modular connectors. The actual crossover of the contact/terminal members occurs in an intermediate bridging portion extending between the contact portion 260 and the terminal portion. More specifically, to provide for the crossover, the intermediate portion of the contact/terminal members which cross over one another are positioned in different planes.

In accordance with the present invention, it has been found that providing a double cross-over of one or more wire pairs will result in reduced near-end cross talk in these wires pairs. Preferably, in data communications applications in which 4 wire pairs are used, a double crossover of wire pairs 1&2, 4&5, and 7&8 is provided. In applications in which only wire pairs 1&2 and 3&6 are used, for example Ethernet applications, a double crossover of wire pairs 1&2 and 3&6 is preferably provided. Moreover, it has been found that by providing a double-crossover of wire pairs in accordance with the invention, a modular jack can be provided which meets EIA/TIA Category 5 minimum near-end cross talk isolation standards.

In addition, by providing a double crossover of the wire pairs, the conventional "footprint" of the RJ type connector is maintained. For example, by providing a double crossover, the positions of wires 1–8 of each port of the connector 10 in accordance with the present invention will be identical to the positions of wires 1–8 in a conventional connector which does not include wire crossovers. This is significant because, by maintaining the conventional RJ type footprint, the double crossover modular connector in accordance with the present invention can be used as a drop-in replacement for conventional connectors. In this manner, the present invention allows electrical components to be upgraded to Category 5 requirements without replacing or altering existing PCBs.

As discussed above with regard to FIGS. 6*a* and 6*b*, in certain applications, it is contemplated that the front portion of the jack 10 will be disposed within a cut-out of a face plate of a larger electrical component housing. In such applications, it is desirable to provide a metallic shield which surrounds the jack 10, and which is grounded to the face plate 510 of the housing 500 or 261. Nevertheless, in other applications, a metal shield is also sometimes desirable.

A metallic shield 1200 in accordance with a preferred embodiment of the invention will now be described with respect to FIGS. 7(*a*) through 15. The shield 1200 may be used independent of the jack 10 described above.

Figure 15:
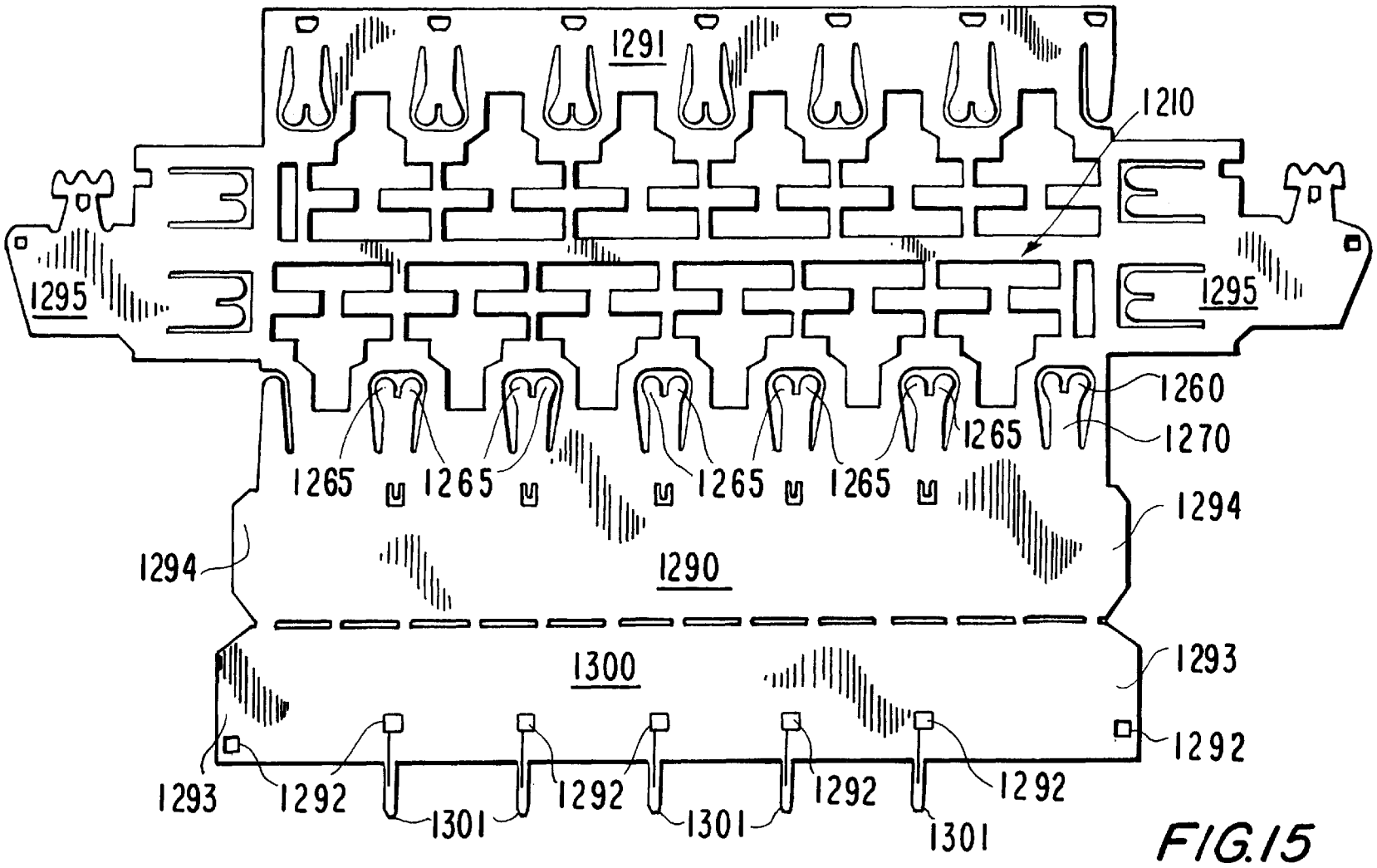
FIG. 15 shows a view of a shield in accordance with the present invention in its flat state.

The metallic shield 1200 is formed, preferably from a single sheet of metal which is flat in its blank state as shown in FIG. 15. Referring to FIGS. 7(*a*) and 15, the shield 1200 is configured to include a face panel 1210, a top panel l290, a back panel 1300, a bottom panel 1291, and a pair of side panels 1295. The shield 1200 is formed into a free-standing unit by folding the top panel 1290, the bottom panel 1291, and the side panels 1295 about 90 degrees inward relative to the face panel 1210. The top panel 1290 further includes a pair of tabs 1294 which are bent over the respective side panels 1295, and the back panel 1300 similarly includes a pair of tabs 1293 which are bent inwardly about 90 degrees. The resulting free-standing structure is shown in FIG. 7*c*. Once the jack 10 is inserted into the shield 1200 in the direction indicated in FIG. 7*c*, the back panel 1300 is bent inwardly about 90 degrees, and the tabs 1293 engage the side panels 1295.

Figure 12:
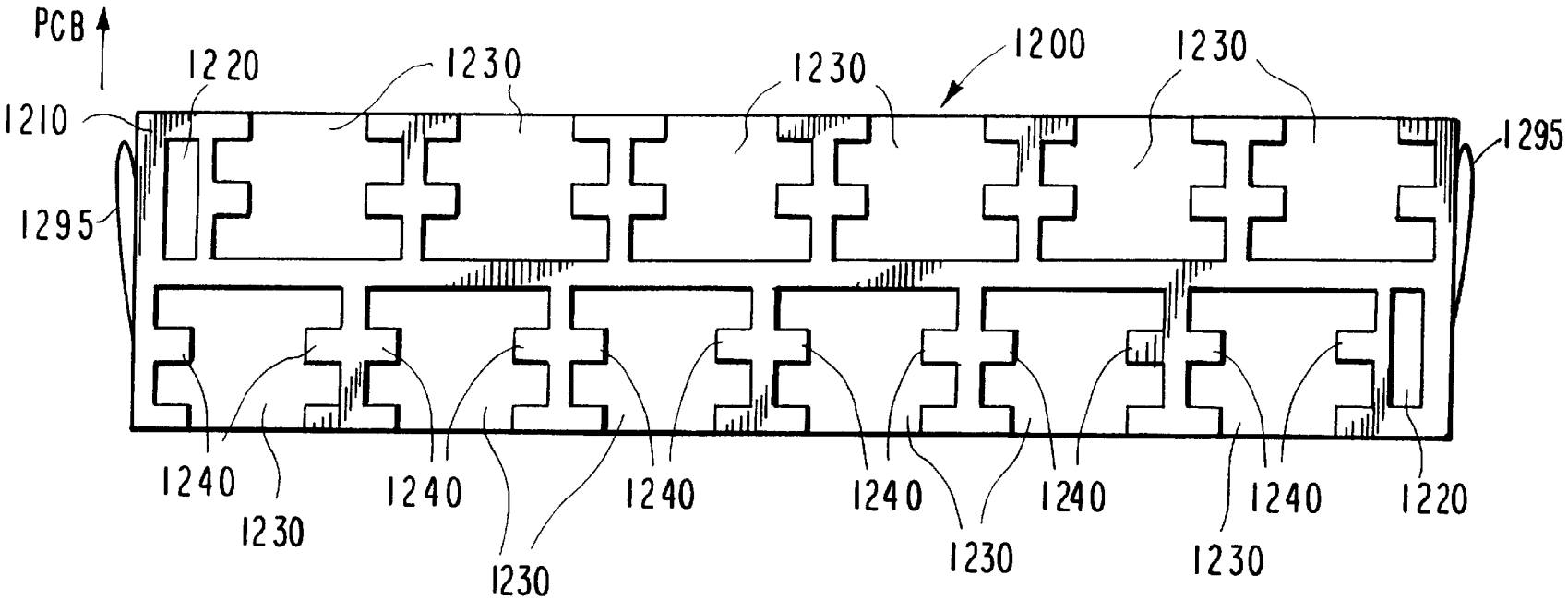
FIG. 12 shows a front view of a shielded bi-level offset multi-port jack in accordance with an embodiment of the invention.

Referring to FIG. 12, the face panel 1210 includes 12 cut-outs 1230 arranged in two substantially parallel rows and which are configured to overlay the upper and lower plug apertures 200, 210 of the jack 10. A pair of opposed tabs 1240 are provided in each cut-out 1230. The tabs 1240 are bent inwardly to reside in respective recesses 1230 in the plug receiving receptacles aligning with the plug apertures 200,210. A pair of cutouts 1220 are also provided in the shield 1200. The cutouts 1220 will overlay the vents 164 of the outer housing part 100 when the shield 1200 is disposed around the jack 10.

Figure 13:
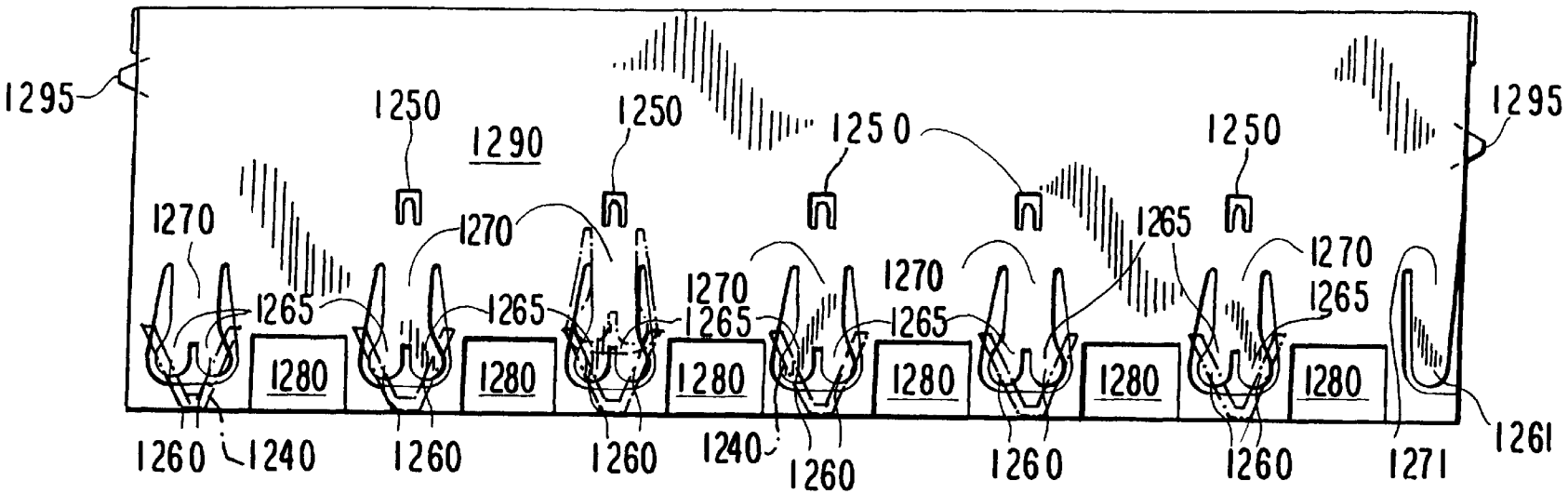
FIG. 13 shows a top view of a shielded bi-level offset multi-port jack in accordance with an embodiment of the invention.

Referring to FIG. 13, the top panel 1290 of the shield 1200 includes five attachment tabs 1250 which are bent downwardly to be secured in respective notches 1251 on the top wall 110 of the outer housing part 100 when the shield 1200 is disposed around the jack 10. Referring to FIGS. 13 and 15, the top panel 1290 further includes bifurcated grounding tabs 1260 and cantilevered spring beams 1270. A trapezoidal grounding tab 1261 and cantilevered spring beam 1271 is also provided. The top panel 1290 also includes six cut-outs 1280 which are configured to overlay respective latching members 250 of the upper receptacles 200 when the shield 1200 is disposed around the jack 10.

Figure 14:
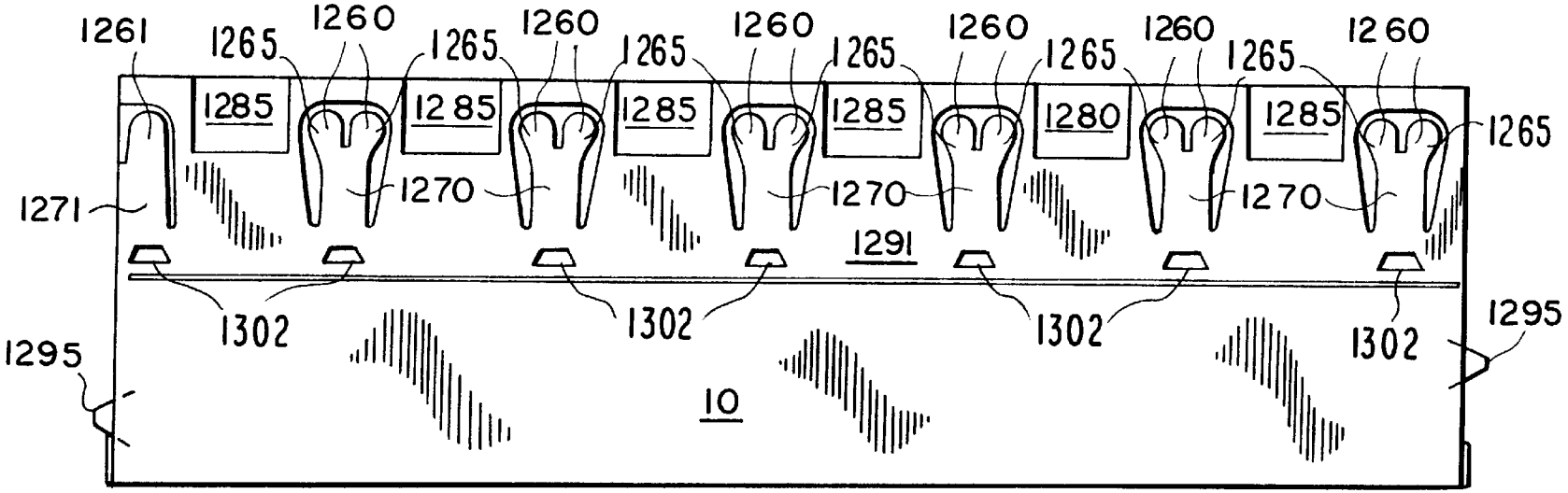
FIG. 14 shows a bottom view of a shielded bi-level offset multi-port jack in accordance with an embodiment of the invention.

Referring to FIG. 14, the bottom panel 1291 is shown disposed around the jack 10. The bottom panel 1291 includes seven staking apertures 1292 (See FIG. 15) which are staked to respective staking posts (unnumbered in FIG. 1E) on the forward bottom 130 of the exterior housing 100 when the shield 1200 is disposed around the jack 10. The bottom panel 1291 further includes bifurcated grounding tabs 1260 and cantilevered spring beams 1270. A trapezoidal grounding tab 1261 and cantilevered spring beam 1271 are also provided. The bottom panel 1291 also includes six cut-outs 1285 which are configured to overlay respective latching members 250 of the lower receptacles 210 when the shield 1200 is disposed around the jack 10. Referring to FIG. 15, the back panel 1300 includes five metallic posts 1301 which are secured to the PCB 300, and six staking apertures 1292 which are secured to respective staking posts (not shown) on the upper back wall 190 of the outer housing 100.

Figure 7A:
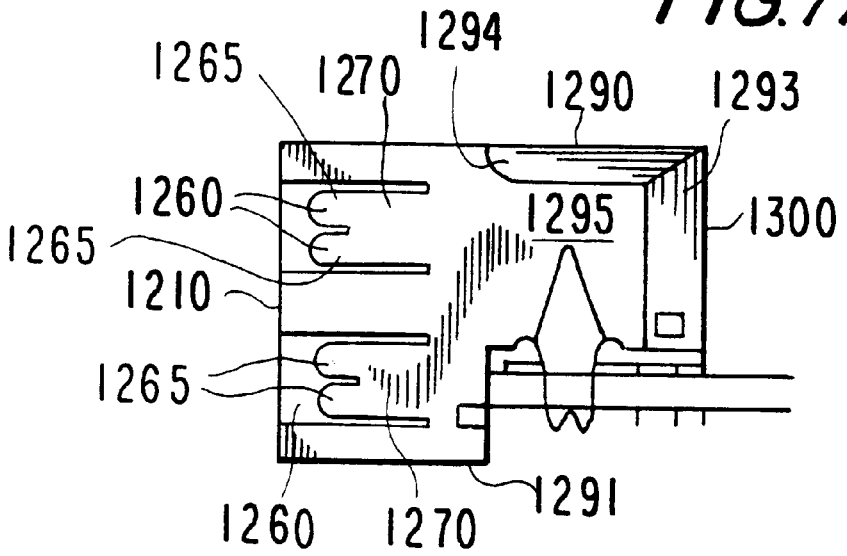
FIG. 7(*a*) shows a side view of the bi-level offset multi-port jack including a shield in accordance with an embodiment of the invention.
Figure 7C:
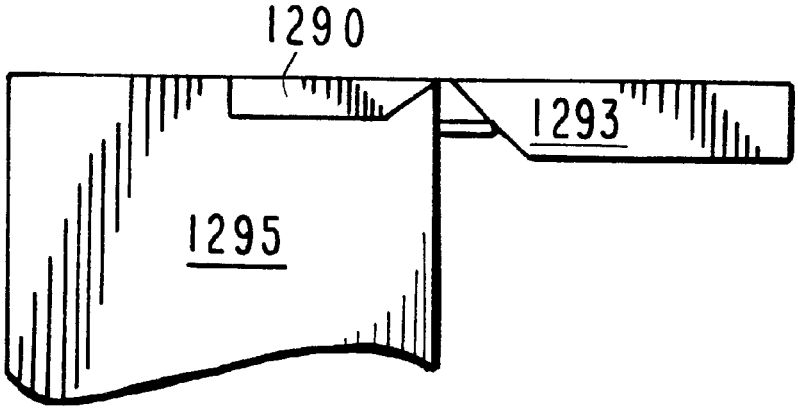
Figure 7B:
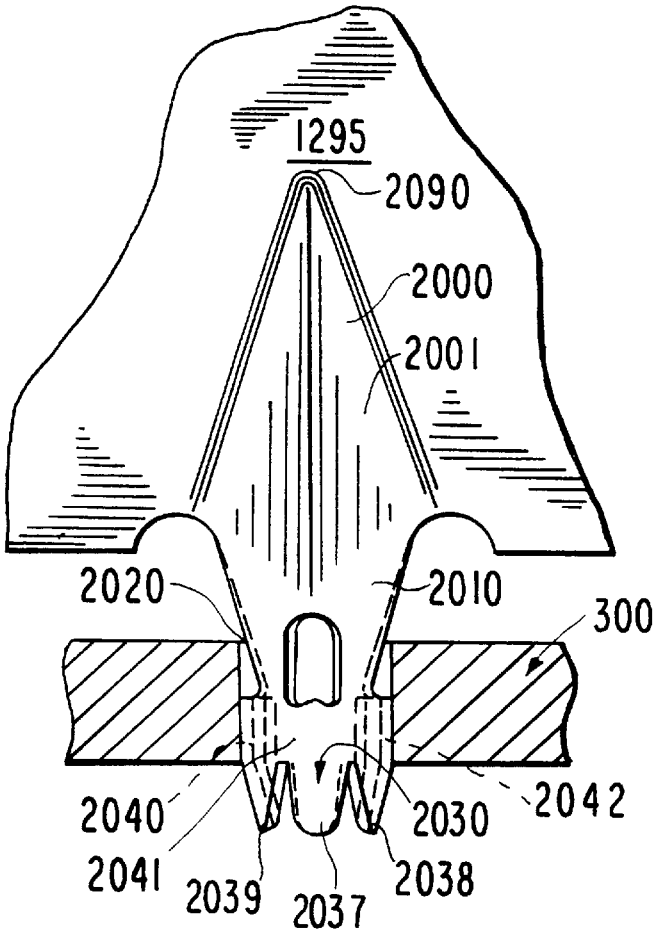
Figure 8:
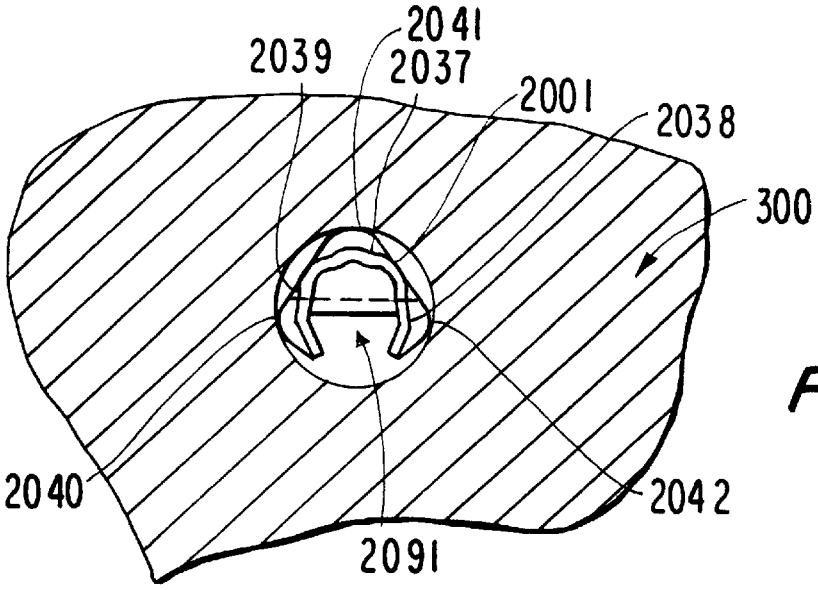
FIG. 8 shows a bottom view of a PCB with the grounding post of FIG. 7(*b*) mounted therein.

Referring to FIGS. 7*a* and 7*b*, each of the side panels 1295 similarly includes a pair of bifurcated grounding tabs 1260 and cantilevered spring beams 1270 Cantilevered spring beam 1270 is formed from the same metallic sheet material as the shield, as is bifurcated grounding tab 1260 which is integral with and extends from an end of the spring beam 1270. As seen in FIGS. 7*a*, 13–15, each bifurcated ground tab 1260 is connected to an extends from an end of a respective cantilevered spring beam 1270. Each side panel 1295 also includes a post 2001 which serves both to provide a reliable mechanical connection between the shielded jack and the PCB, and a good electrical connection to the PCB ground, which includes a leg portion 2010 and a foot portion 2030. Referring to FIGS. 7(*b*) through 11, the side panel 1295 preferably includes a gusseted mount portion 2000 to increase the strength of the grounding post 2001. The gusseted mount portion 2000 has a generally concave shape that tapers to a point 2090 at its upper end.

Figure 9:
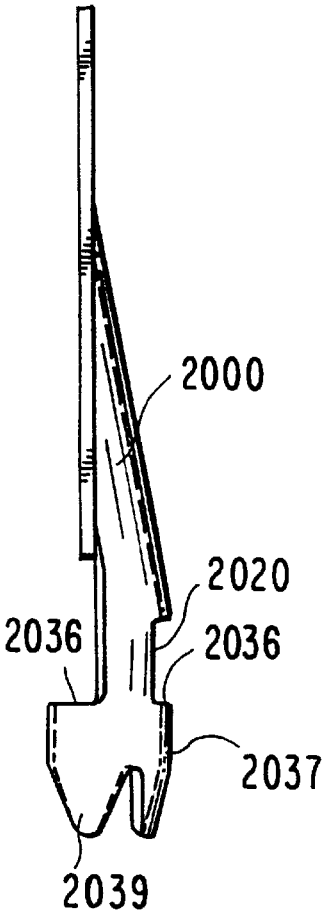
FIG. 9 shows a front view of the grounding post of FIG. 7(*b*) in its uncompressed state.
Figure 10:
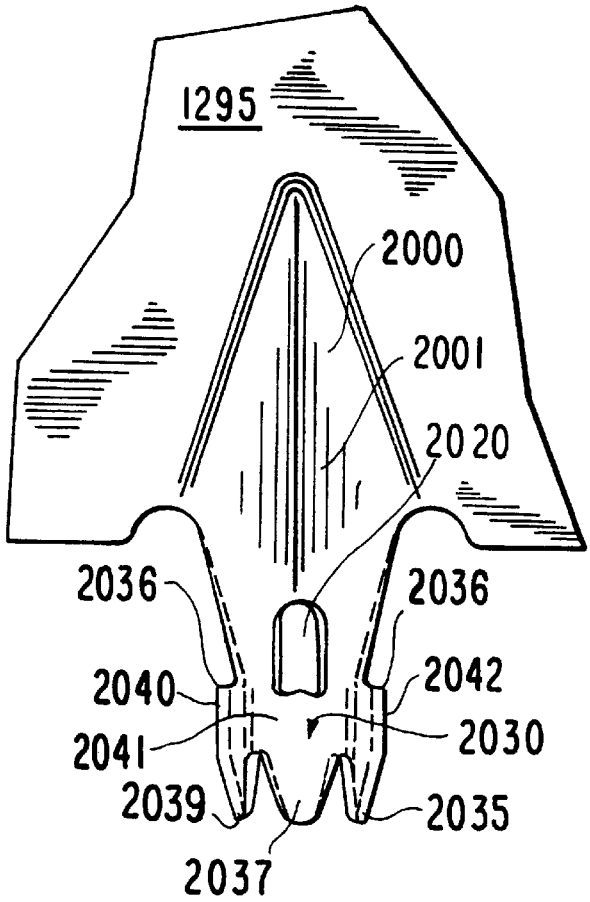
FIG. 10 shows a side view of the grounding post of FIG. 7(*b*) in its uncompressed state.
Figure 11:
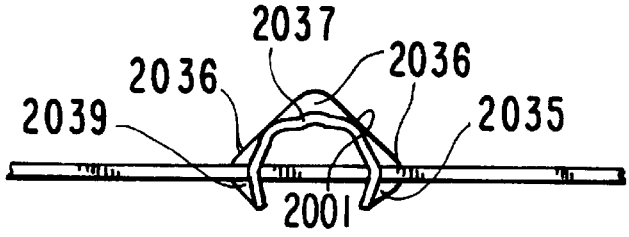
FIG. 11 shows a bottom view of the grounding post of FIG. 7(*b*) in its uncompressed state.

As shown in FIG. 9, the leg portion 2010 and the foot portion 2030 have a generally concave shape. In the embodiment shown in FIGS. 7(*b*) through 11, the foot portion 2030 includes a center mount side 2041 which terminates at one end in a center tine 2037 and terminates at another end at retention edge 2036. The foot portion 2030 also includes a pair of outer mount sides 2040, 2042 which terminate at one end in respective outer tines 2035, 2039 and terminate at another end at respective retention edges 2036. A cutout 2020 is provided in the leg portion 2010 to form the retention edge 2036 on the center mount side 2041. In their uncompressed condition, as shown in FIGS. 10 and 11, the diameter B between the outer surfaces of the mount sides 2040 and 2042 is greater than the diameter of the mounting hole 2091 in the PCB 300. However, the diameter C between the outer tines 2039 and 2035 is less than the diameter of the mounting hole 2091 in the PCB 300. Consequently, as the foot portion 2030 is inserted into the hole 2091 in the PCB, the tines 2035, 2037, 2039 and the mount sides 2040, 2041, 2042 will compress inwardly to provide a press fit between the mount sides 2040, 2041, 2042 and the mounting hole 2091 that insures a reliable mechanical attachment to the PCB as well as an electrical connection to the PCB ground. As shown in FIG. 7(*b*), once the foot portion 2030 is fully inserted into the hole 2091, the mount sides 2040, 2041, 2042 are securely engaged to the wall of the hole 2091.

Figure 3C:
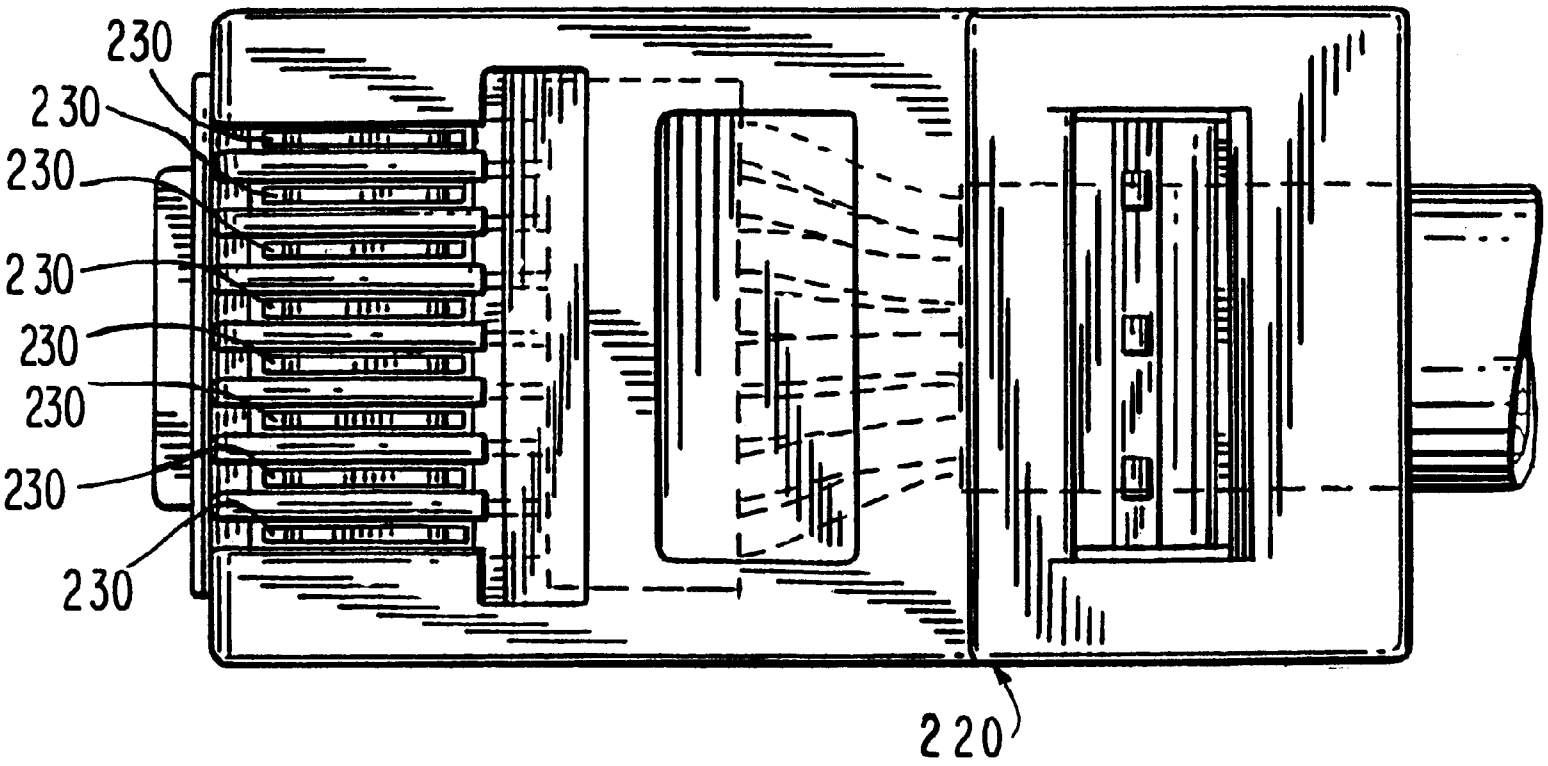
FIG. 3C (PRIOR ART)
Figure 3D:
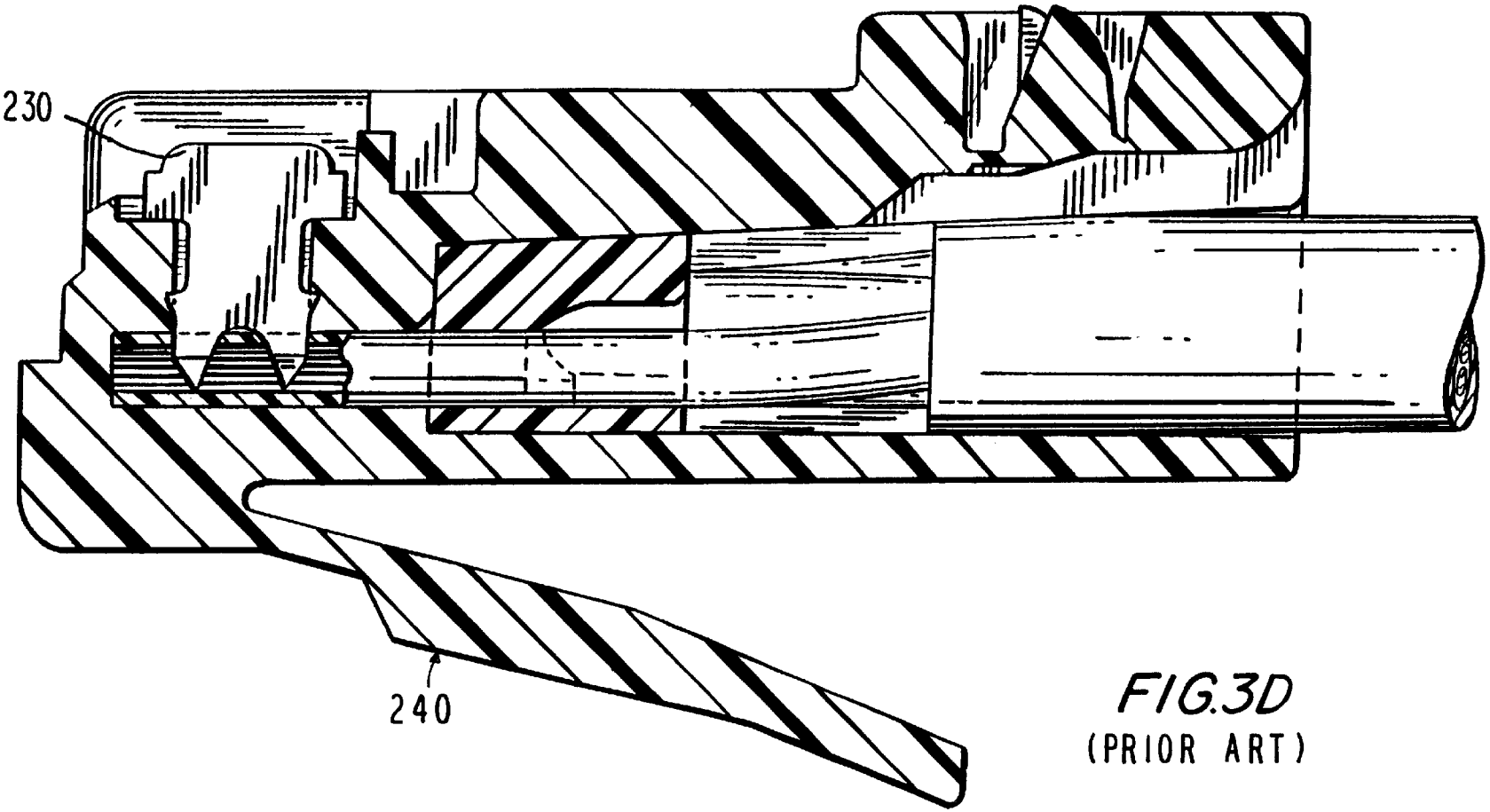
FIG.3D (PRIOR ART)
Figure 16:
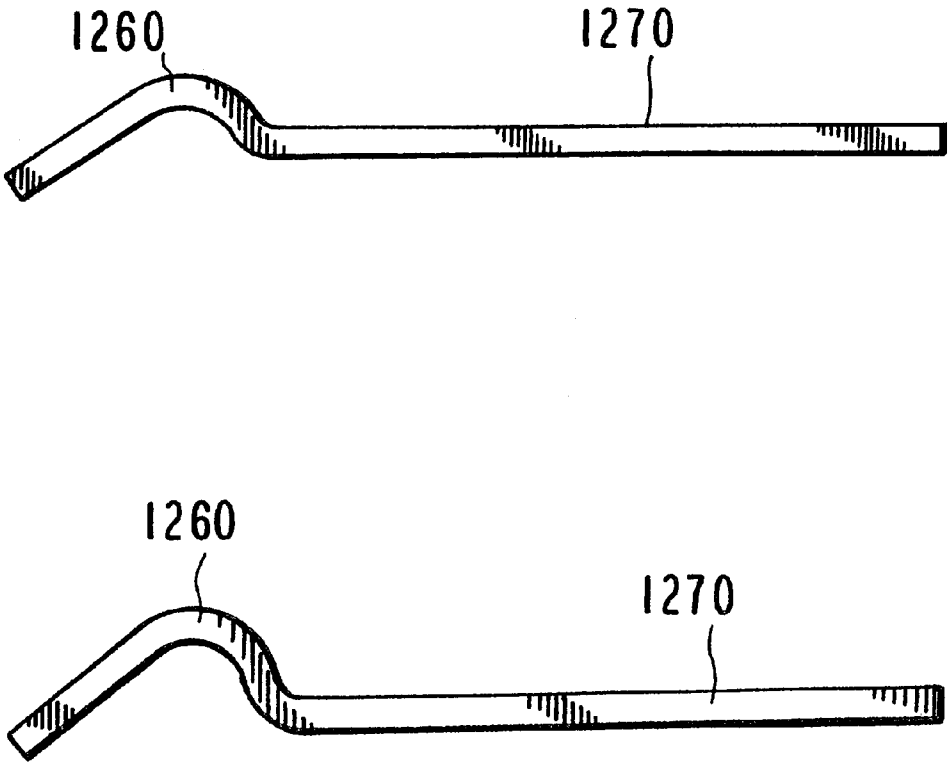
FIG. 16 shows a side view of a bifurcated grounding tab and cantilever beam in accordance with an embodiment of the invention.

When ajack 10 having the shield 1200 mounted thereon is mounted within a cut-out of a face plate of a larger housing (as shown in FIGS. 6*a*, 6*b*, and 3*c*), the bifurcated grounding tabs 1260 establish a ground connection between the shield 1200 and the face plate. In this regard, the cantilevered spring beams 1270 maintain a secure electrical connection between the shield 1200 and the face plate by applying an outward force to the bifurcated grounding tabs 1260. A side view of the bifurcated grounding tabs 1260 and cantilevered spring beams 1270 is shown in FIG. 16.

In addition, in accordance with this embodiment, a single cantilevered spring beam 1270 applies a force to two grounding points (the two fingers 1265 of each bifurcated grounding tab 1260), allowing a densely packed arrangement of grounding points. Moreover, since the two fingers 1265 of the bifurcated grounding tabs are connected to a central cantilevered spring beam 1270, the fingers 1265 can rotate relative to the spring beam 1270 in order to provide contact to the face plate.

In accordance with a further embodiment of the present invention, one or more of the bifurcated grounding tabs 1260 are offset rearwardly with respect to the other grounding tabs 1260 (as indicated with dashed lines in FIG. 13). By providing such a staggered configuration, the tolerances for the distance between the face 1210 of the shield 1200 and the face plate can be increased. In addition, this configuration reduces the installation force which needs to be applied when inserting the jack 10 and shield 1200 through the cutout in the face plate.

In accordance with a further embodiment of the invention, the cutouts 1280 and 1285 exhibit a tapered configuration as shown in FIG. 15. In FIG. 15, the cutouts 1280, 1285 have a first width at their forward end 2086, 2081, and a second, smaller width at their rearward end 2085,2081. With this configuration, the latch 240 of a plug inserted into the jack is restrained in its movement toward the top (in the case of cutout 1280) or bottom (in the case of cutout 1285) of the jack, while still maintaining a secure engagement with the jack. In this manner, the latch 240 will not interfere, for example, with the removal of an adjacent U-Shaped housing 261 of FIG. 3*c*.

Figure 17:
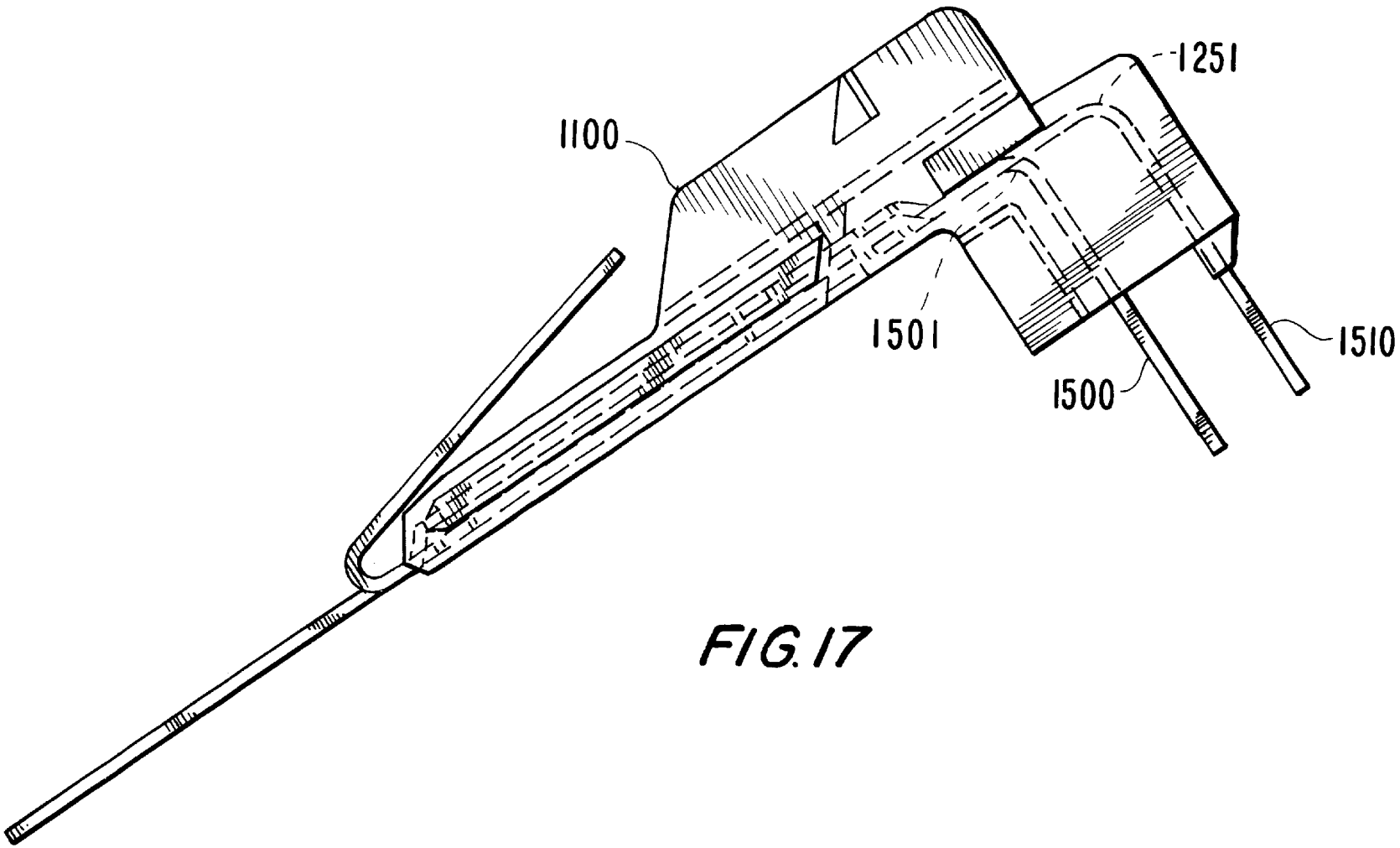
FIG. 17 shows the molding position for the an upper inner housing part of FIG. 3*a*.

In accordance with another aspect of the invention, the upper and lower inserts 1000 and 1100 are manufactured by injection molding. Preferably, the molding position for the upper and lower inserts 1000 and 1100 is 35 degrees or more offset from horizontal as illustrated in FIG. 17. With this manufacturing method, it is possible to manufacture a single piece insert (such as inserts 1000, 1100) using an insert injection molding technique, while employing carrier strips to situate the contact/terminal members in the mold. In accordance with the method according to the invention, the contact/terminal members are formed as a pair of carrier strips, with the interior row of members (e.g. 1010.8, 1010.7, 1010.6, 1010.5) forming one carrier strip and the exterior row of members (e.g. 1010.1, 1010.2, 1010.3, 1010.4) forming the other carrier strip. The members in each carrier strip are maintained in a predetermined spaced apart array because the contact end of each wire terminates in a first common attachment strip, and the terminal end of each wire terminates in a second common attachment strip. The use of such a carrier strip facilitates the injection molding process because individual members need not be handled. It should be noted that the members in the carrier strip may be formed with the double cross-over arrangement described above.

Figure 18:
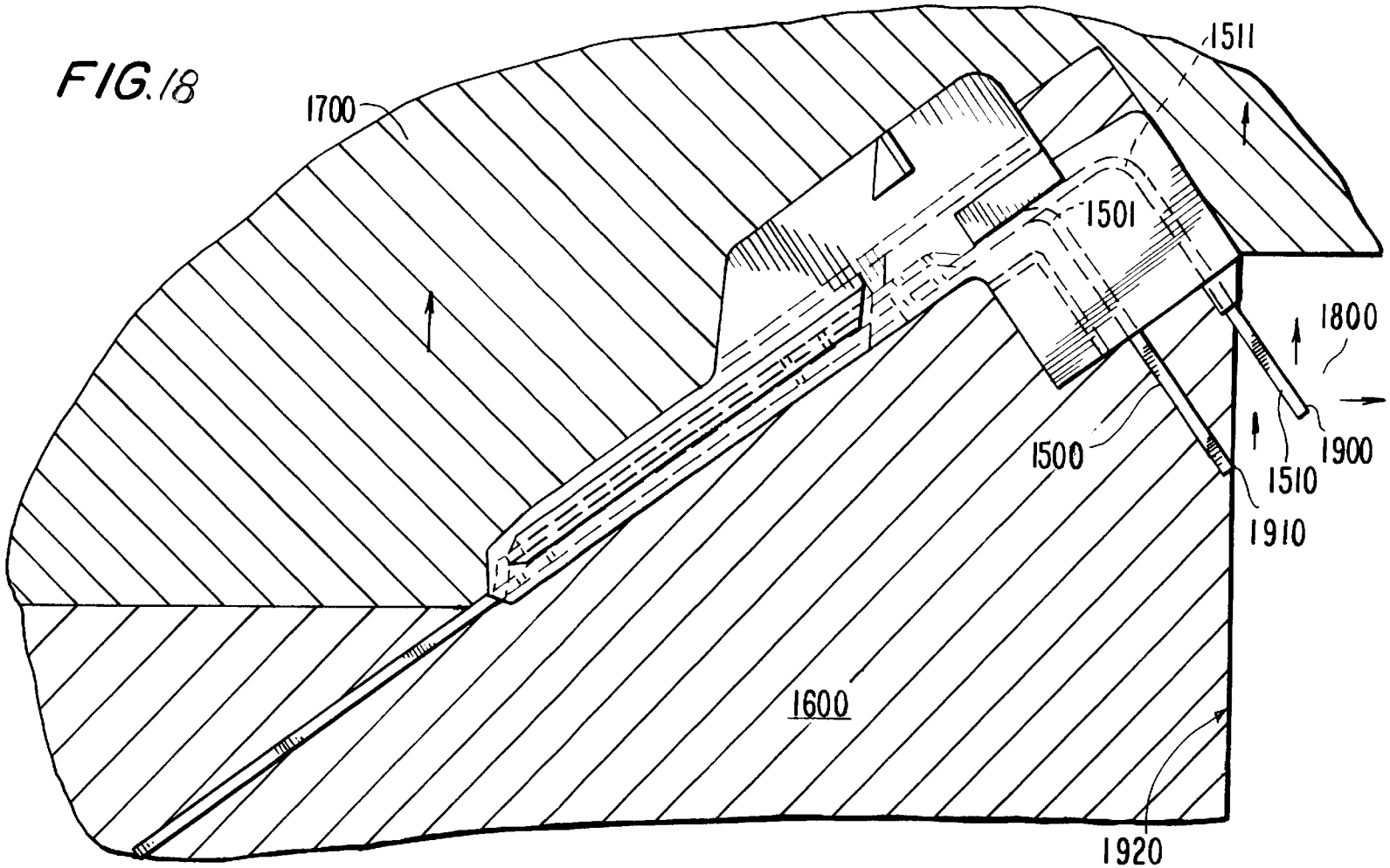
FIG. 18 shows the positioning of the inner housing part relative to a base portion of a mold, a vertically movable upper portion of the mold, and a laterally moving side portion of the mold in accordance with an embodiment of the invention.

In any case, referring to FIG. 17, the carrier strips 1500, 1510 are pre-bent at points 1501 and 1511 prior insertion into the mold. In accordance with the invention, the molding position of the part is set at 35 degrees or more from horizontal as shown in FIGS. 17 and 18 (and preferably at 35 degrees). By providing this molding position, it is possible to mold the insert 1110 in one piece utilizing carrier strips. Referring to FIG. 18, the mold includes a base portion 1600, an upper portion 1700, and a sliding portion 1800. The carrier strips 1500, 1510 are placed in the base portion 1600. During the molding process, the base portion 1600, upper portion 1700, and sliding portion 1800 are in the position indicated in FIG. 18 so that the mold is closed, and dielectric material can flow into the mold to form the part. Once dielectric material has solidified, the upper portion 1700 moves vertically upward and the sliding portion 1800 moves laterally to the right as indicated by the arrows in FIG. 18. It is important to note that in order for the insert 1100 to be removed from the mold, the attachment strips 1900 and 1910 must clear the steel shutoff 1920. Referring to FIG. 18, in order for the attachment strip 1910 to clear the steel shutoff 1920, the assembly must be molded at an angle greater than or equal to 35 degrees from horizontal.

Obviously, numerous modifications and variations of the present invention are possible in light of the above teachings. Accordingly, it is understood that other embodiments of the invention are possible in the light of the above teachings.

We claim:

1. A metallic shield for a jack, comprising:

a plurality of planar panels formed of metallic sheet material, each for overlying an outer surface of a respective outer wall of the jack, a front one of said panels including at least one aperture for allowing passage of a plug therethrough, side, top and bottom ones of said panels being situated adjacent said front panel and being bendable relative to said front panel, at least one of said side, top and bottom panels having at least one cantilevered spring beam formed from said metallic sheet material and at least one bifurcated grounding tab integral with and extending from an end of each of said at least one spring beam.

2. The shield of claim 1, wherein said at least one spring beam is substantially planar and rotatable relative to a plane of said at least one panel, each of said at least one bifurcated grounding tab including a pair of fingers extending out of the plane of said spring beam integral therewith and outward from the jack.

3. The shield of claim 1, wherein said shield includes at least one attachment tab adapted to be secured within a respective notch in one of the outer walls of the jack.

4. The shield of claim 1, wherein said shield includes at least one staking aperture adapted to engage with a respective staking post on one of the outer walls of the jack.

5. The shield of claim 1, wherein one of said panels of said shield includes a PCB grounding post.

6. The shield of claim 5, wherein said PCB grounding post includes a leg portion and a foot portion including at least one mount side terminating in a tine, said foot portion being adapted to be inserted into a mounting hole in a printed circuit board to which the jack is mounted such that upon insertion of said foot portion, said at least one mount side is compressed inwardly and presses against sides of the mounting hole.

7. The shield of claim 1, wherein said shield is formed from a single sheet of metallic material.

8. The shield of claim 1, wherein said front panel has a mid-portion arranged to define a first row of at least one aperture on one side of said mid-portion and a second row of at least one aperture on another side of said mid-portion.

9. The shield of claim 1, further comprising a plurality of spring beams, said spring beams being arranged in a row on said at least one panel.

10. The shield of claim 1, further comprising a plurality of spring beams, said at least one grounding tab of at least one of said plurality of spring beams being offset with respect to said at least one grounding tab of at least one other of said plurality of spring beams and relative to said front panel.

11. A metallic shield for a jack, comprising:

a plurality of planar panels formed of metallic sheet material, each for overlying an outer surface of a respective outer wall of the jack, a front one of said panels including at least one aperture for allowing passage of a plug therethrough, and at least one post integrally formed with said metallic shield for mounting the jack to a printed circuit board, said at least one post being arranged on a respective one of said panels and including a leg portion and a foot portion having a generally concave shape to thereby project outward from a plane in which the respective one of said panels is situated, said foot portion including at least one mount side defining a retention edge and a tine, said tine being adapted to guide insertion of said foot portion into a mounting hole on the printed circuit board such that said retention edge abuts against at least one edge of the mounting hole.

12. The shield of claim 11, wherein said shield is formed from a single sheet of metallic material.

13. The shield of claim 11, further comprising two posts, each said post arranged on a respective one of said panels overlying a lateral wall of the jack.

14. A method for retaining a shield about a jack, comprising the step of:

forming an outwardly extending staking post on and integral with an outer wall of the jack, providing a shield with an aperture arranged to receive said staking post, placing the shield over the jack such that said staking post extends through said aperture, and applying pressure to said staking post to cause said staking post to be deformed and retain the shield.

15. The method of claim 14, wherein the application of pressure is accomplished through the application of heat which results in an increase of pressure.

16. The method of claim 14, wherein the jack is provided with a plurality of staking posts and the shield is provided with a plurality of apertures.

17. The shield of claim 11 wherein said post comprises part of said metallic sheet material extending from a respective one of said shield panels.

18. The shield of claim 17 wherein said respective one of said shield panels comprises a panel overlying a lateral wall of the jack.

19. The shield of claim 17 wherein said post contains a leg portion and a foot portion.

20. The shield of claim 19 wherein said foot portion contains gussets.

21. The shield of claim 17 wherein said post contains gussets.

22. The shield of claim 17 wherein said post is of a generally concave shape.

23. The shield of claim 1, wherein said at least one spring beam is elongate and extends longitudinally in a direction perpendicular to an edge between said front panel and said at least one panel on which said at least one spring beam is situated.

24. The shield of claim 1, wherein each of said side, top and bottom panels has at least one cantilevered spring beam formed from said metallic sheet material and at least one bifurcated grounding tab integral with and extending from an end of each of said at least one spring beam.

25. The shield of claim 2, wherein said fingers are spaced from one another.

26. The shield of claim 11, wherein said leg portion extends from above an edge of the respective one of said panels to below the edge of the respective one of said panels, said leg portion being concave at locations above and below the edge of the respective one of said panels.

27. The shield of claim 11, wherein said at least one post further comprises two additional mount sides, each of said additional mount sides including a tine and a retention edge.

* * * * *